US008913001B2

(12) United States Patent
Yamada

(10) Patent No.: US 8,913,001 B2
(45) Date of Patent: Dec. 16, 2014

(54) CONTROL DEVICE, ELECTROOPTICS DEVICE, ELECTRONIC EQUIPMENT, AND CONTROL METHOD

(71) Applicant: Seiko Epson Corporation, Tokyo (JP)

(72) Inventor: Yusuke Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 258 days.

(21) Appl. No.: 13/661,467

(22) Filed: Oct. 26, 2012

(65) Prior Publication Data

US 2013/0120473 A1 May 16, 2013

(30) Foreign Application Priority Data

Nov. 10, 2011 (JP) ..... 2011-246622

(51) Int. Cl.
*G09G 3/34* (2006.01)
*G09G 3/20* (2006.01)

(52) U.S. Cl.
CPC ..... *G09G 3/34* (2013.01); *G09G 2310/04* (2013.01); *G09G 3/2085* (2013.01); *G09G 3/344* (2013.01); *G09G 2310/027* (2013.01); *G09G 2340/16* (2013.01)
USPC ..... 345/107; 345/690

(58) Field of Classification Search
CPC ..... G09G 3/344; G09G 2310/04
USPC ..... 345/107
See application file for complete search history.

(56) References Cited

U.S. PATENT DOCUMENTS

| | | | | |
|---|---|---|---|---|
| 2009/0040201 | A1* | 2/2009 | Kim et al. | 345/204 |
| 2009/0046114 | A1* | 2/2009 | Lee et al. | 345/691 |
| 2009/0256798 | A1 | 10/2009 | Low et al. | |
| 2011/0001748 | A1 | 1/2011 | Rutman et al. | |
| 2011/0216046 | A1* | 9/2011 | Nishizawa | 345/204 |
| 2011/0279432 | A1* | 11/2011 | Yamada | 345/211 |
| 2012/0044276 | A1* | 2/2012 | Yamada | 345/690 |
| 2013/0127933 | A1* | 5/2013 | Yamamoto | 345/691 |

FOREIGN PATENT DOCUMENTS

| | | |
|---|---|---|
| JP | 2009-251615 A | 10/2009 |
| JP | 2011-237709 A | 11/2011 |

* cited by examiner

*Primary Examiner* — Dorothy Harris
(74) *Attorney, Agent, or Firm* — ALG Intellectual Property, LLC

(57) ABSTRACT

For a target pixel to be processed among plural pixels, when a comparison result between the gray level value stored in the first memory and the gray level value stored in the second memory, and the remainder frequency stored in the third memory meet a predetermined condition, the control device rewrites the remainder frequency to a set value decided according to the gray level value stored in the second memory, and the control device performs a cleanup processing to display a predetermined image at the plural pixels with a predetermined timing.

17 Claims, 22 Drawing Sheets

| FRAME NUMBER | | 0 | | | | | 5 | | | | | 10 | | | | | 15 | | | | | 20 | | | | | 25 |
|---|---|---|---|---|---|---|---|---|---|---|---|---|---|---|---|---|---|---|---|---|---|---|---|---|---|---|---|
| PRESENT MEMORY C(j,i) | PIXEL 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | PIXEL 2 | 0 | 0 | 0 | 0 | 0 | 0 | 0 | 1 | 1 | 1 | 1 | 1 | 1 | 1 | 1 | 1 | 1 | 1 | 1 | 1 | 1 | 1 | 1 | 1 | 1 | 1 |
| | PIXEL 3 | 0 | 0 | 0 | 0 | 0 | 0 | 0 | 1 | 1 | 1 | 1 | 1 | 1 | 1 | 1 | 1 | 1 | 1 | 1 | 1 | 1 | 1 | 1 | 1 | 1 | 1 |
| | PIXEL 4 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| NEXT MEMORY N(j,i) | PIXEL 1 | 0 | 0 | 1 | 1 | 0 | 0 | 0 | 0 | 0 | 0 | 1 | 1 | 0 | 0 | 0 | 0 | 0 | 0 | 1 | 1 | 0 | 0 | 0 | 0 | 0 | 0 |
| | PIXEL 2 | 0 | 0 | 1 | 1 | 1 | 1 | 1 | 1 | 0 | 0 | 1 | 1 | 1 | 1 | 1 | 1 | 0 | 0 | 1 | 1 | 1 | 1 | 1 | 1 | 1 | 1 |
| | PIXEL 3 | 0 | 0 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 |
| | PIXEL 4 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 1 | 1 |
| OPTICAL STATE H | PIXEL 1 | 0 | 0 | 1 | 4 | 3 | 2 | 1 | 0 | 0 | 0 | 1 | 4 | 3 | 2 | 1 | 0 | 0 | 0 | 1 | 4 | 3 | 2 | 1 | 0 | 0 | 0 |
| | PIXEL 2 | 0 | 0 | 1 | 4 | 5 | 5 | 5 | 5 | 4 | 3 | 5 | 5 | 5 | 5 | 5 | 5 | 4 | 3 | 5 | 5 | 5 | 5 | 5 | 5 | 5 | 5 |
| | PIXEL 3 | 0 | 0 | 1 | 4 | 5 | 5 | 5 | 5 | 5 | 5 | 5 | 5 | 5 | 5 | 5 | 5 | 5 | 5 | 5 | 5 | 5 | 5 | 5 | 5 | 5 | 5 |
| | PIXEL 4 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| APPLIED VOLTAGE V | PIXEL 1 | 0 | 0 | + | + | - | - | - | - | - | 0 | + | + | - | - | - | - | - | 0 | + | + | - | - | - | - | - | 0 |
| | PIXEL 2 | 0 | 0 | + | + | + | + | + | 0 | - | - | + | + | + | + | + | 0 | - | - | + | + | + | + | + | 0 | 0 | 0 |
| | PIXEL 3 | 0 | 0 | + | + | + | + | + | 0 | 0 | 0 | 0 | 0 | 0 | 0 | 0 | 0 | 0 | 0 | 0 | 0 | 0 | 0 | 0 | 0 | 0 | 0 |
| | PIXEL 4 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| REMAINDER FREQUENCY MEMORY R(j,i) | PIXEL 1 | 0 | 0 | 5 | 4 | -5 | -4 | -3 | -2 | -1 | 0 | 5 | 4 | -5 | -4 | -3 | -2 | -1 | 0 | 5 | 4 | -5 | -4 | -3 | -2 | -1 | 0 |
| | PIXEL 2 | 0 | 0 | 5 | 4 | 3 | 2 | 1 | 0 | -5 | -4 | 5 | 4 | 3 | 2 | 1 | 0 | -5 | -4 | 5 | 4 | 3 | 2 | 1 | 0 | 0 | 0 |
| | PIXEL 3 | 0 | 0 | 5 | 4 | 3 | 2 | 1 | 0 | 0 | 0 | 0 | 0 | 0 | 0 | 0 | 0 | 0 | 0 | 0 | 0 | 0 | 0 | 0 | 0 | 0 | 0 |
| | PIXEL 4 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| FREQUENCY DIFFERENCE MEMORY D(j,i) | PIXEL 1 | 0 | 0 | 1 | 2 | 1 | 0 | -1 | -2 | -3 | -3 | -2 | -1 | -2 | -3 | -4 | -5 | -6 | -6 | -5 | -4 | -5 | -6 | -7 | -8 | -9 | -9 |
| | PIXEL 2 | 0 | 0 | 1 | 2 | 3 | 4 | 5 | 5 | 4 | 3 | 4 | 5 | 6 | 7 | 8 | 8 | 7 | 6 | 7 | 8 | 9 | 10 | 11 | 11 | 11 | 11 |
| | PIXEL 3 | 0 | 0 | 1 | 2 | 3 | 4 | 5 | 5 | 5 | 5 | 5 | 5 | 5 | 5 | 5 | 5 | 5 | 5 | 5 | 5 | 5 | 5 | 5 | 5 | 5 | 5 |
| | PIXEL 4 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG. 8

| FRAME NUMBER | | 25 | | | | | 30 | | | | | 35 | | | | | 40 | | | | | 45 | | | | | 50 | | | | | 55 | | | | | 60 | | | | | | 50+(10×k) | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| PRESENT MEMORY C(j,i) | PIXEL 1 | 0 | 0 | 0 | 0 | 0 | 0 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 1 | 1 | 1 | 1 | 1 | 1 | | 1 | 1 | 1 | 1 | 1 | 0 | 0 | 0 | 0 | 0 | 0 |
| | PIXEL 2 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 1 | 1 | 1 | 1 | 1 | 1 | ... | 1 | 1 | 1 | 1 | 1 | 0 | 0 | 0 | 0 | 0 | 1 |
| | PIXEL 3 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 1 | 1 | 1 | 1 | 1 | 1 | | 1 | 1 | 1 | 1 | 1 | 0 | 0 | 0 | 0 | 0 | 0 |
| | PIXEL 4 | 0 | 0 | 0 | 0 | 0 | 0 | 1 | 1 | 1 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 | 1 | 1 | 1 | 1 | 1 | 1 | | 1 | 1 | 1 | 1 | 1 | 0 | 0 | 0 | 0 | 0 | 1 |
| NEXT MEMORY N(j,i) | PIXEL 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | | 0 | 0 | 0 | 0 | 0 | 0 | 0 | 0 | 0 | 0 | 0 |
| | PIXEL 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | ... | 1 | 1 | 1 | 1 | 1 | 1 | 1 | 1 | 1 | 1 | 1 |
| | PIXEL 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | | 0 | 0 | 0 | 0 | 0 | 0 | 0 | 0 | 0 | 0 | 0 |
| | PIXEL 4 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | | 1 | 1 | 1 | 1 | 1 | 1 | 1 | 1 | 1 | 1 | 1 |
| OPTICAL STATE H | PIXEL 1 | 0 | 1 | 4 | 5 | 5 | 5 | 5 | 5 | 5 | 5 | 5 | 5 | 5 | 5 | 5 | 4 | 3 | 2 | 1 | 0 | 0 | 0 | 0 | 0 | 0 | 0 | 1 | 2 | 3 | 4 | 5 | 4 | 3 | 2 | 1 | 0 | | | 4 | 3 | 2 | 1 | 0 | 0 | 0 | 0 | 0 | 0 | 0 |
| | PIXEL 2 | 5 | 5 | 5 | 5 | 5 | 5 | 5 | 5 | 5 | 5 | 5 | 5 | 5 | 5 | 5 | 4 | 3 | 2 | 1 | 0 | 0 | 0 | 0 | 0 | 0 | 0 | 1 | 2 | 3 | 4 | 5 | 4 | 3 | 2 | 1 | 0 | | ... | 4 | 3 | 2 | 1 | 0 | 1 | 4 | 5 | 5 | 5 | 5 |
| | PIXEL 3 | 5 | 5 | 5 | 5 | 5 | 5 | 5 | 5 | 5 | 5 | 5 | 5 | 5 | 5 | 5 | 4 | 3 | 2 | 1 | 0 | 0 | 0 | 0 | 0 | 0 | 0 | 1 | 2 | 3 | 4 | 5 | 4 | 3 | 2 | 1 | 0 | | | 4 | 3 | 2 | 1 | 0 | 0 | 0 | 0 | 0 | 0 | 0 |
| | PIXEL 4 | 0 | 1 | 4 | 5 | 5 | 5 | 5 | 5 | 5 | 5 | 5 | 5 | 5 | 5 | 5 | 4 | 3 | 2 | 1 | 0 | 0 | 0 | 0 | 0 | 0 | 0 | 1 | 2 | 3 | 4 | 5 | 4 | 3 | 2 | 1 | 0 | | | 4 | 3 | 2 | 1 | 0 | 1 | 4 | 5 | 5 | 5 | 5 |
| APPLIED VOLTAGE V | PIXEL 1 | 0 | + | + | + | + | + | + | + | + | + | + | + | + | + | + | - | - | - | - | - | 0 | 0 | 0 | 0 | 0 | 0 | + | + | + | + | + | - | - | - | - | - | | | - | - | - | - | - | 0 | 0 | 0 | 0 | 0 | 0 |
| | PIXEL 2 | 0 | 0 | 0 | 0 | 0 | 0 | 0 | 0 | 0 | 0 | 0 | 0 | 0 | 0 | 0 | - | - | - | - | - | - | - | - | - | - | - | + | + | + | + | + | - | - | - | - | - | | ... | - | - | - | - | - | + | + | + | + | + | 0 |
| | PIXEL 3 | 0 | 0 | 0 | 0 | 0 | 0 | 0 | 0 | 0 | 0 | 0 | 0 | 0 | 0 | 0 | - | - | - | - | - | 0 | 0 | 0 | 0 | 0 | 0 | + | + | + | + | + | - | - | - | - | - | | | - | - | - | - | - | 0 | 0 | 0 | 0 | 0 | 0 |
| | PIXEL 4 | 0 | + | + | + | + | + | 0 | 0 | 0 | 0 | 0 | 0 | 0 | 0 | 0 | - | - | - | - | - | 0 | 0 | 0 | 0 | 0 | 0 | + | + | + | + | + | - | - | - | - | - | | | - | - | - | - | - | + | + | + | + | + | 0 |
| REMAINDER FREQUENCY MEMORY R(j,i) | PIXEL 1 | 0 | 5 | 4 | 3 | 2 | 1 | 0 | 0 | 0 | 0 | 0 | 0 | 0 | 0 | 0 | -5 | -4 | -3 | -2 | -1 | 0 | 0 | 0 | 0 | 0 | 0 | 5 | 4 | 3 | 2 | 1 | -5 | -4 | -3 | -2 | -1 | | | -5 | -4 | -3 | -2 | -1 | 0 | 0 | 0 | 0 | 0 | 0 |
| | PIXEL 2 | 0 | 0 | 0 | 0 | 0 | 0 | 0 | 0 | 0 | 0 | 0 | 0 | 0 | 0 | 0 | -5 | -4 | -3 | -2 | -1 | 0 | 0 | 0 | 0 | 0 | 0 | 5 | 4 | 3 | 2 | 1 | -5 | -4 | -3 | -2 | -1 | | ... | -5 | -4 | -3 | -2 | -1 | 5 | 4 | 3 | 2 | 1 | 0 |
| | PIXEL 3 | 0 | 0 | 0 | 0 | 0 | 0 | 0 | 0 | 0 | 0 | 0 | 0 | 0 | 0 | 0 | -5 | -4 | -3 | -2 | -1 | 0 | 0 | 0 | 0 | 0 | 0 | 5 | 4 | 3 | 2 | 1 | -5 | -4 | -3 | -2 | -1 | | | -5 | -4 | -3 | -2 | -1 | 0 | 0 | 0 | 0 | 0 | 0 |
| | PIXEL 4 | 0 | 5 | 4 | 3 | 2 | 1 | 0 | 0 | 0 | 0 | 0 | 0 | 0 | 0 | 0 | -5 | -4 | -3 | -2 | -1 | 0 | 0 | 0 | 0 | 0 | 0 | 5 | 4 | 3 | 2 | 1 | -5 | -4 | -3 | -2 | -1 | | | -5 | -4 | -3 | -2 | -1 | 5 | 4 | 3 | 2 | 1 | 0 |
| FREQUENCY DIFFERENCE MEMORY D(j,i) | PIXEL 1 | -9 | -8 | -7 | -6 | -5 | -4 | -3 | -2 | -1 | 0 | 1 | 2 | 3 | 4 | 5 | 4 | 3 | 2 | 1 | 0 | 0 | 0 | 0 | 0 | 0 | 0 | 1 | 2 | 3 | 4 | 5 | 4 | 3 | 2 | 1 | 0 | | | 4 | 3 | 2 | 1 | 0 | 0 | 0 | 0 | 0 | 0 | 0 |
| | PIXEL 2 | 11 | 11 | 11 | 11 | 11 | 11 | 11 | 11 | 11 | 11 | 11 | 11 | 11 | 11 | 11 | 10 | 9 | 8 | 7 | 6 | 5 | 4 | 3 | 2 | 1 | 0 | 1 | 2 | 3 | 4 | 5 | 4 | 3 | 2 | 1 | 0 | | ... | 4 | 3 | 2 | 1 | 0 | 1 | 2 | 3 | 4 | 5 | 5 |
| | PIXEL 3 | 5 | 5 | 5 | 5 | 5 | 5 | 5 | 5 | 5 | 5 | 5 | 5 | 5 | 5 | 5 | 4 | 3 | 2 | 1 | 0 | 0 | 0 | 0 | 0 | 0 | 0 | 1 | 2 | 3 | 4 | 5 | 4 | 3 | 2 | 1 | 0 | | | 4 | 3 | 2 | 1 | 0 | 0 | 0 | 0 | 0 | 0 | 0 |
| | PIXEL 4 | 0 | 1 | 2 | 3 | 4 | 5 | 5 | 5 | 5 | 5 | 5 | 5 | 5 | 5 | 5 | 4 | 3 | 2 | 1 | 0 | 0 | 0 | 0 | 0 | 0 | 0 | 1 | 2 | 3 | 4 | 5 | 4 | 3 | 2 | 1 | 0 | | | 4 | 3 | 2 | 1 | 0 | 1 | 2 | 3 | 4 | 5 | 5 |

FIG. 12

| FRAME NUMBER | | 25 | | | | | 30 | | | | | 35 | | | | | 40 | | | | | 45 | | | | | 50 | | | | | 55 | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| PRESENT MEMORY C(j,i) | PIXEL 1 | 0 | 0 | 0 | 0 | 0 | 0 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 | ... | 0 | 0 | 0 | 0 | 0 | 1 | 1 | 1 | 1 | 1 | 0 |
| | PIXEL 2 | 1 | 1 | 1 | 1 | 1 | 1 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 | | 0 | 0 | 0 | 0 | 0 | 1 | 1 | 1 | 1 | 1 | 1 |
| | PIXEL 3 | 1 | 1 | 1 | 1 | 1 | 1 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 | | 0 | 0 | 0 | 0 | 0 | 1 | 1 | 1 | 1 | 1 | 0 |
| | PIXEL 4 | 0 | 0 | 0 | 0 | 0 | 0 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 | | 0 | 0 | 0 | 0 | 0 | 1 | 1 | 1 | 1 | 1 | 1 |
| NEXT MEMORY N(j,i) | PIXEL 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | ... | 0 | 0 | 0 | 0 | 0 | 0 | 0 | 0 | 0 | 0 | 0 |
| | PIXEL 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | | 1 | 1 | 1 | 1 | 1 | 1 | 1 | 1 | 1 | 1 | 1 |
| | PIXEL 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | | 0 | 0 | 0 | 0 | 0 | 0 | 0 | 0 | 0 | 0 | 0 |
| | PIXEL 4 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | | 1 | 1 | 1 | 1 | 1 | 1 | 1 | 1 | 1 | 1 | 1 |
| OPTICAL STATE H | PIXEL 1 | 0 | 0 | 0 | 0 | 0 | 0 | 0 | 0 | 0 | 0 | 0 | 0 | 1 | 4 | 5 | 5 | 5 | 5 | 5 | 5 | 5 | 5 | 5 | 5 | 5 | 5 | 4 | 3 | 2 | 1 | 0 | ... | 1 | 4 | 5 | 5 | 5 | 4 | 3 | 2 | 1 | 0 | 0 |
| | PIXEL 2 | 5 | 4 | 3 | 2 | 1 | 0 | 0 | 0 | 0 | 0 | 0 | 0 | 1 | 4 | 5 | 5 | 5 | 5 | 5 | 5 | 5 | 5 | 5 | 5 | 5 | 5 | 4 | 3 | 2 | 1 | 0 | | 1 | 4 | 5 | 5 | 5 | 5 | 5 | 5 | 5 | 5 | 5 |
| | PIXEL 3 | 5 | 4 | 3 | 2 | 1 | 0 | 0 | 0 | 0 | 0 | 0 | 0 | 1 | 4 | 5 | 5 | 5 | 5 | 5 | 5 | 5 | 5 | 5 | 5 | 5 | 5 | 4 | 3 | 2 | 1 | 0 | | 1 | 4 | 5 | 5 | 5 | 4 | 3 | 2 | 1 | 0 | 0 |
| | PIXEL 4 | 0 | 0 | 0 | 0 | 0 | 0 | 0 | 0 | 0 | 0 | 0 | 0 | 1 | 4 | 5 | 5 | 5 | 5 | 5 | 5 | 5 | 5 | 5 | 5 | 5 | 5 | 4 | 3 | 2 | 1 | 0 | | 1 | 4 | 5 | 5 | 5 | 5 | 5 | 5 | 5 | 5 | 5 |
| APPLIED VOLTAGE V | PIXEL 1 | 0 | 0 | 0 | 0 | 0 | 0 | 0 | 0 | 0 | 0 | 0 | 0 | + | + | + | + | + | + | + | + | + | + | + | + | + | + | - | - | - | - | - | ... | + | + | + | + | + | - | - | - | - | - | 0 |
| | PIXEL 2 | 0 | - | - | - | - | - | - | - | - | - | - | - | + | + | + | + | + | 0 | 0 | 0 | 0 | 0 | 0 | 0 | 0 | 0 | - | - | - | - | - | | + | + | + | + | + | 0 | 0 | 0 | 0 | 0 | 0 |
| | PIXEL 3 | 0 | - | - | - | - | - | 0 | 0 | 0 | 0 | 0 | 0 | + | + | + | + | + | 0 | 0 | 0 | 0 | 0 | 0 | 0 | 0 | 0 | - | - | - | - | - | | + | + | + | + | + | - | - | - | - | - | 0 |
| | PIXEL 4 | 0 | 0 | 0 | 0 | 0 | 0 | 0 | 0 | 0 | 0 | 0 | 0 | + | + | + | + | + | 0 | 0 | 0 | 0 | 0 | 0 | 0 | 0 | 0 | - | - | - | - | - | | + | + | + | + | + | 0 | 0 | 0 | 0 | 0 | 0 |
| REMAINDER FREQUENCY MEMORY R(j,i) | PIXEL 1 | 0 | 0 | 0 | 0 | 0 | 0 | 0 | 0 | 0 | 0 | 0 | 0 | 5 | 4 | 3 | 2 | 1 | 0 | 0 | 0 | 0 | 0 | 0 | 0 | 0 | 0 | -5 | -4 | -3 | -2 | -1 | ... | 5 | 4 | 3 | 2 | 1 | -5 | -4 | -3 | -2 | -1 | 0 |
| | PIXEL 2 | 0 | -5 | -4 | -3 | -2 | -1 | 0 | 0 | 0 | 0 | 0 | 0 | 5 | 4 | 3 | 2 | 1 | 0 | 0 | 0 | 0 | 0 | 0 | 0 | 0 | 0 | -5 | -4 | -3 | -2 | -1 | | 5 | 4 | 3 | 2 | 1 | 0 | 0 | 0 | 0 | 0 | 0 |
| | PIXEL 3 | 0 | -5 | -4 | -3 | -2 | -1 | 0 | 0 | 0 | 0 | 0 | 0 | 5 | 4 | 3 | 2 | 1 | 0 | 0 | 0 | 0 | 0 | 0 | 0 | 0 | 0 | -5 | -4 | -3 | -2 | -1 | | 5 | 4 | 3 | 2 | 1 | -5 | -4 | -3 | -2 | -1 | 0 |
| | PIXEL 4 | 0 | 0 | 0 | 0 | 0 | 0 | 0 | 0 | 0 | 0 | 0 | 0 | 5 | 4 | 3 | 2 | 1 | 0 | 0 | 0 | 0 | 0 | 0 | 0 | 0 | 0 | -5 | -4 | -3 | -2 | -1 | | 5 | 4 | 3 | 2 | 1 | 0 | 0 | 0 | 0 | 0 | 0 |
| FREQUENCY DIFFERENCE MEMORY D(j,i) | PIXEL 1 | -9 | -9 | -9 | -9 | -9 | -9 | -9 | -9 | -9 | -9 | -9 | -9 | -8 | -7 | -6 | -5 | -4 | -3 | -2 | -1 | 0 | 1 | 2 | 3 | 4 | 5 | 4 | 3 | 2 | 1 | 0 | ... | 1 | 2 | 3 | 4 | 5 | 4 | 3 | 2 | 1 | 0 | 0 |
| | PIXEL 2 | 11 | 10 | 9 | 8 | 7 | 6 | 5 | 4 | 3 | 2 | 1 | 0 | 1 | 2 | 3 | 4 | 5 | 5 | 5 | 5 | 5 | 5 | 5 | 5 | 5 | 5 | 4 | 3 | 2 | 1 | 0 | | 1 | 2 | 3 | 4 | 5 | 5 | 5 | 5 | 5 | 5 | 5 |
| | PIXEL 3 | 5 | 4 | 3 | 2 | 1 | 0 | 0 | 0 | 0 | 0 | 0 | 0 | 1 | 2 | 3 | 4 | 5 | 5 | 5 | 5 | 5 | 5 | 5 | 5 | 5 | 5 | 4 | 3 | 2 | 1 | 0 | | 1 | 2 | 3 | 4 | 5 | 4 | 3 | 2 | 1 | 0 | 0 |
| | PIXEL 4 | 0 | 0 | 0 | 0 | 0 | 0 | 0 | 0 | 0 | 0 | 0 | 0 | 1 | 2 | 3 | 4 | 5 | 5 | 5 | 5 | 5 | 5 | 5 | 5 | 5 | 5 | 4 | 3 | 2 | 1 | 0 | | 1 | 2 | 3 | 4 | 5 | 5 | 5 | 5 | 5 | 5 | 5 |

FIG. 13

| | FRAME NUMBER | 25 | | | | | 30 | | | | | 35 | | | | | 40 | | | | | 45 | | | | |

| FRAME NUMBER | | 25 | | | | | 30 | | | | | 35 | | | | | 40 | | | | | 45 | | | | |

FRAME NUMBER 0 5 10 15 20 25 30

NEXT MEMORY N(j,i)

| | | |

FRAME NUMBER 0 5 10 15 20 25 30

REMAINDER FREQUENCY MEMORY R(j,i)

| | | |

| FRAME NUMBER | 0 | | | | | 5 | | | | | 10 | | | | | 15 | | | | | 20 | | | | | 25 | | | | | 30 | | | | |

REMAINDER FREQUENCY MEMORY R(j,i)

| FRAME NUMBER | 0 | | | | | 5 | | | | | 10 | | | | | 15 | | | | | 20 | | | | | 25 | | | | | 30 | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| PIXEL 1 | 0 | 0 | 0 | 0 | 0 | 0 | 0 | 0 | 0 | 0 | 0 | 0 | 5 | 4 | 3 | 2 | 1 | -5 | -4 | -3 | -2 | -1 | 5 | 4 | 3 | 2 | 1 | -5 | -4 | -3 | -2 | -1 | | -5 | -4 | -3 | -2 | -1 | 0 | 0 | 0 | 0 | 0 | 0 |
| PIXEL 2 | 0 | 0 | 0 | 0 | 0 | 0 | 0 | 0 | 0 | 0 | 0 | 0 | 5 | 4 | 3 | 2 | 1 | -5 | -4 | -3 | -2 | -1 | 5 | 4 | 3 | 2 | 1 | -5 | -4 | -3 | -2 | -1 | | -5 | -4 | -3 | -2 | -1 | 0 | 0 | 0 | 0 | 0 | 0 |
| PIXEL 3 | 0 | 0 | 0 | 0 | 0 | 0 | 0 | 0 | 0 | 0 | 0 | 0 | 5 | 4 | 3 | 2 | 1 | -5 | -4 | -3 | -2 | -1 | 5 | 4 | 3 | 2 | 1 | -5 | -4 | -3 | -2 | -1 | | -5 | -4 | -3 | -2 | -1 | 0 | 0 | 0 | 0 | 0 | 0 |
| PIXEL 4 | 0 | 0 | 0 | 0 | 0 | 0 | 0 | 0 | 0 | 0 | 0 | 0 | 5 | 4 | 3 | 2 | 1 | -5 | -4 | -3 | -2 | -1 | 5 | 4 | 3 | 2 | 1 | -5 | -4 | -3 | -2 | -1 | ... | -5 | -4 | -3 | -2 | -1 | 0 | 0 | 0 | 0 | 0 | 0 |
| PIXEL 5 | 0 | 0 | 0 | 0 | 0 | 0 | 0 | 0 | 0 | 0 | 0 | 0 | 5 | 4 | 3 | 2 | 1 | -5 | -4 | -3 | -2 | -1 | 5 | 4 | 3 | 2 | 1 | -5 | -4 | -3 | -2 | -1 | | -5 | -4 | -3 | -2 | -1 | 5 | 4 | 3 | 2 | 1 | 0 |
| PIXEL 6 | 0 | 0 | 0 | 0 | 0 | 0 | 0 | 0 | 0 | 0 | 0 | 0 | 5 | 4 | 3 | 2 | 1 | -5 | -4 | -3 | -2 | -1 | 5 | 4 | 3 | 2 | 1 | -5 | -4 | -3 | -2 | -1 | | -5 | -4 | -3 | -2 | -1 | 5 | 4 | 3 | 2 | 1 | 0 |
| PIXEL 7 | 0 | 0 | 0 | 0 | 0 | 0 | 0 | 0 | 0 | 0 | 0 | 0 | 5 | 4 | 3 | 2 | 1 | -5 | -4 | -3 | -2 | -1 | 5 | 4 | 3 | 2 | 1 | -5 | -4 | -3 | -2 | -1 | | -5 | -4 | -3 | -2 | -1 | 5 | 4 | 3 | 2 | 1 | 0 |
| PIXEL 8 | 0 | 0 | 0 | 0 | 0 | 0 | 0 | 0 | 0 | 0 | 0 | 0 | 5 | 4 | 3 | 2 | 1 | -5 | -4 | -3 | -2 | -1 | 5 | 4 | 3 | 2 | 1 | -5 | -4 | -3 | -2 | -1 | | -5 | -4 | -3 | -2 | -1 | 5 | 4 | 3 | 2 | 1 | 0 |

FREQUENCY DIFFERENCE MEMORY D(j,i)

| | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| PIXEL 1 | -9 | -8 | -7 | -6 | -5 | -4 | -3 | -2 | -1 | 0 | 0 | 0 | 1 | 2 | 3 | 4 | 5 | 4 | 3 | 2 | 1 | 0 | 1 | 2 | 3 | 4 | 5 | 4 | 3 | 2 | 1 | 0 | | 4 | 3 | 2 | 1 | 0 | 0 | 0 | 0 | 0 | 0 | 0 |
| PIXEL 2 | 11 | 10 | 9 | 8 | 7 | 6 | 5 | 4 | 3 | 2 | 1 | 0 | 1 | 2 | 3 | 4 | 5 | 4 | 3 | 2 | 1 | 0 | 1 | 2 | 3 | 4 | 5 | 4 | 3 | 2 | 1 | 0 | | 4 | 3 | 2 | 1 | 0 | 0 | 0 | 0 | 0 | 0 | 0 |
| PIXEL 3 | 1 | 0 | 0 | 0 | 0 | 0 | 0 | 0 | 0 | 0 | 0 | 0 | 1 | 2 | 3 | 4 | 5 | 4 | 3 | 2 | 1 | 0 | 1 | 2 | 3 | 4 | 5 | 4 | 3 | 2 | 1 | 0 | | 4 | 3 | 2 | 1 | 0 | 0 | 0 | 0 | 0 | 0 | 0 |
| PIXEL 4 | 0 | 0 | 0 | 0 | 0 | 0 | 0 | 0 | 0 | 0 | 0 | 0 | 1 | 2 | 3 | 4 | 5 | 4 | 3 | 2 | 1 | 0 | 1 | 2 | 3 | 4 | 5 | 4 | 3 | 2 | 1 | 0 | ... | 4 | 3 | 2 | 1 | 0 | 0 | 0 | 0 | 0 | 0 | 0 |
| PIXEL 5 | 0 | 0 | 0 | 0 | 0 | 0 | 0 | 0 | 0 | 0 | 0 | 0 | 1 | 2 | 3 | 4 | 5 | 4 | 3 | 2 | 1 | 0 | 1 | 2 | 3 | 4 | 5 | 4 | 3 | 2 | 1 | 0 | | 4 | 3 | 2 | 1 | 0 | 1 | 2 | 3 | 4 | 5 | 5 |
| PIXEL 6 | -3 | -2 | -1 | 0 | 0 | 0 | 0 | 0 | 0 | 0 | 0 | 0 | 1 | 2 | 3 | 4 | 5 | 4 | 3 | 2 | 1 | 0 | 1 | 2 | 3 | 4 | 5 | 4 | 3 | 2 | 1 | 0 | | 4 | 3 | 2 | 1 | 0 | 1 | 2 | 3 | 4 | 5 | 5 |
| PIXEL 7 | 8 | 7 | 6 | 5 | 4 | 3 | 2 | 1 | 0 | 0 | 0 | 0 | 1 | 2 | 3 | 4 | 5 | 4 | 3 | 2 | 1 | 0 | 1 | 2 | 3 | 4 | 5 | 4 | 3 | 2 | 1 | 0 | | 4 | 3 | 2 | 1 | 0 | 1 | 2 | 3 | 4 | 5 | 5 |
| PIXEL 8 | 5 | 4 | 3 | 2 | 1 | 0 | 0 | 0 | 0 | 0 | 0 | 0 | 1 | 2 | 3 | 4 | 5 | 4 | 3 | 2 | 1 | 0 | 1 | 2 | 3 | 4 | 5 | 4 | 3 | 2 | 1 | 0 | | 4 | 3 | 2 | 1 | 0 | 1 | 2 | 3 | 4 | 5 | 5 |

FIG. 17B

| FRAME NUMBER | | 0 | | | | 5 | | | | 10 | | | | 15 | | | | 20 | | | | 25 | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| PRESENT MEMORY C(j,i) | PIXEL 1 | 0 | 0 | 0 | 0 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | ... | 0 | 0 | 0 | 0 | 0 | 1 | 1 | 1 | 1 | 1 | 1 |
| | PIXEL 2 | 1 | 1 | 1 | 1 | 1 | 1 | 0 | 0 | 0 | 0 | 0 | 0 | 0 | 0 | 0 | 1 | 1 | 1 | 1 | 1 | 1 | 1 | 1 | 1 | 1 | 1 | | 0 | 0 | 0 | 0 | 0 | 1 | 1 | 1 | 1 | 1 | 0 |
| NEXT MEMORY N(j,i) | PIXEL 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | ... | 1 | 1 | 1 | 1 | 1 | 1 | 1 | 1 | 1 | 1 | 1 |
| | PIXEL 2 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | | 0 | 0 | 0 | 0 | 0 | 0 | 0 | 0 | 0 | 0 | 0 |
| OPTICAL STATE H | PIXEL 1 | 0 | 0 | 0 | 0 | 0 | 0 | 0 | 0 | 0 | 0 | 1 | 4 | 5 | 5 | 5 | 5 | 5 | 5 | 5 | 5 | 5 | 4 | 3 | 2 | 1 | 0 | ... | 0 | 1 | 4 | 5 | 5 | 5 | 5 | 5 | 5 | 5 | 5 |
| | PIXEL 2 | 5 | 4 | 3 | 2 | 1 | 0 | 0 | 0 | 0 | 0 | 1 | 4 | 5 | 5 | 5 | 5 | 5 | 5 | 5 | 5 | 5 | 4 | 3 | 2 | 1 | 0 | | 0 | 1 | 4 | 5 | 5 | 4 | 3 | 2 | 1 | 0 | 0 |
| APPLIED VOLTAGE V | PIXEL 1 | 0 | 0 | 0 | 0 | 0 | 0 | 0 | 0 | 0 | 0 | + | + | + | + | + | + | + | + | + | + | + | - | - | - | - | - | ... | + | + | + | + | + | 0 | 0 | 0 | 0 | 0 | 0 |
| | PIXEL 2 | 0 | - | - | - | - | - | - | - | - | - | + | + | + | + | + | + | + | + | + | + | + | - | - | - | - | - | | + | + | + | + | + | - | - | - | - | - | 0 |
| REMAINDER FREQUENCY MEMORY R(j,i) | PIXEL 1 | 0 | 0 | 0 | 0 | 0 | 0 | 0 | 0 | 0 | 0 | 5 | 4 | 3 | 2 | 1 | 0 | 0 | 0 | 0 | 0 | 0 | -5 | -4 | -3 | -2 | -1 | ... | 5 | 4 | 3 | 2 | 1 | 0 | 0 | 0 | 0 | 0 | 0 |
| | PIXEL 2 | 0 | -5 | -4 | -3 | -2 | -1 | 0 | 0 | 0 | 0 | 5 | 4 | 3 | 2 | 1 | 0 | 0 | 0 | 0 | 0 | 0 | -5 | -4 | -3 | -2 | -1 | | 5 | 4 | 3 | 2 | 1 | -5 | -4 | -3 | -2 | -1 | 0 |
| FREQUENCY DIFFERENCE MEMORY D(j,i) | PIXEL 1 | -6 | -6 | -6 | -6 | -6 | -6 | -6 | -6 | -6 | -6 | -5 | -4 | -3 | -2 | -1 | 0 | 1 | 2 | 3 | 4 | 5 | 4 | 3 | 2 | 1 | 0 | ... | 1 | 2 | 3 | 4 | 5 | 5 | 5 | 5 | 5 | 5 | 5 |
| | PIXEL 2 | 3 | 2 | 1 | 0 | -1 | -2 | -3 | -4 | -5 | -6 | -5 | -4 | -3 | -2 | -1 | 0 | 1 | 2 | 3 | 4 | 5 | 4 | 3 | 2 | 1 | 0 | | 1 | 2 | 3 | 4 | 5 | 4 | 3 | 2 | 1 | 0 | 0 |

FIG. 18

| FRAME NUMBER | | 25 | | | | | 30 | | | | | 35 | | | | | 40 | | | | | 45 | | | | | 50 | | | | | 55 | | | | |
|---|---|---|---|---|---|---|---|---|---|---|---|---|---|---|---|---|---|---|---|---|---|---|---|---|---|---|---|---|---|---|---|---|---|---|---|---|
| PRESENT MEMORY C(j,i) | PIXEL 1 | 0 | 0 | 0 | 0 | 0 | 0 | 1 | 1 | 1 | 1 | 1 | 1 | 1 | 1 | 0 | 0 | 0 | 0 | 0 | 1 | 1 | 1 | 1 | 1 | 1 | 1 | 1 | 0 | 0 | 0 | 0 | 0 | 1 | 1 | 1 |
| | PIXEL 2 | 1 | 1 | 1 | 1 | 1 | 1 | 0 | 0 | 0 | 0 | 0 | 0 | 0 | 0 | 1 | 1 | 1 | 1 | 1 | 0 | 0 | 0 | 0 | 0 | 0 | 0 | 0 | 1 | 1 | 1 | 1 | 1 | 0 | 0 | 0 |
| | PIXEL 3 | 1 | 1 | 1 | 1 | 1 | 1 | 0 | 0 | 0 | 0 | 0 | 0 | 0 | 0 | 1 | 1 | 1 | 1 | 1 | 0 | 0 | 0 | 0 | 0 | 0 | 0 | 0 | 1 | 1 | 1 | 1 | 1 | 0 | 0 | 0 |
| | PIXEL 4 | 0 | 0 | 0 | 0 | 0 | 0 | 1 | 1 | 1 | 1 | 1 | 1 | 1 | 1 | 0 | 0 | 0 | 0 | 0 | 1 | 1 | 1 | 1 | 1 | 1 | 1 | 1 | 0 | 0 | 0 | 0 | 0 | 1 | 1 | 1 |
| NEXT MEMORY N(j,i) | PIXEL 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | PIXEL 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | PIXEL 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | PIXEL 4 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| OPTICAL STATE H | PIXEL 1 | 0 | 1 | 4 | 5 | 5 | 5 | 5 | 5 | 5 | 4 | 3 | 2 | 1 | 0 | 1 | 4 | 5 | 5 | 5 | 5 | 5 | 5 | 4 | 3 | 2 | 1 | 0 | 1 | 4 | 5 | 5 | 5 | 5 | 5 | 5 |
| | PIXEL 2 | 5 | 4 | 3 | 2 | 1 | 0 | 0 | 0 | 0 | 1 | 4 | 5 | 5 | 5 | 4 | 3 | 2 | 1 | 0 | 0 | 0 | 0 | 1 | 4 | 5 | 5 | 5 | 4 | 3 | 2 | 1 | 0 | 0 | 0 | 0 |
| | PIXEL 3 | 5 | 4 | 3 | 2 | 1 | 0 | 0 | 0 | 0 | 1 | 4 | 5 | 5 | 5 | 4 | 3 | 2 | 1 | 0 | 0 | 0 | 0 | 1 | 4 | 5 | 5 | 5 | 4 | 3 | 2 | 1 | 0 | 0 | 0 | 0 |
| | PIXEL 4 | 0 | 1 | 4 | 5 | 5 | 5 | 5 | 5 | 5 | 4 | 3 | 2 | 1 | 0 | 1 | 4 | 5 | 5 | 5 | 5 | 5 | 5 | 4 | 3 | 2 | 1 | 0 | 1 | 4 | 5 | 5 | 5 | 5 | 5 | 5 |
| APPLIED VOLTAGE V | PIXEL 1 | 0 | + | + | + | + | + | + | + | + | - | - | - | - | - | + | + | + | + | + | + | + | + | - | - | - | - | - | + | + | + | + | + | + | + | + |
| | PIXEL 2 | 0 | - | - | - | - | - | - | - | - | + | + | + | + | + | - | - | - | - | - | - | - | - | + | + | + | + | + | - | - | - | - | - | 0 | 0 | 0 |
| | PIXEL 3 | 0 | - | - | - | - | - | 0 | 0 | 0 | + | + | + | + | + | - | - | - | - | - | 0 | 0 | 0 | + | + | + | + | + | - | - | - | - | - | 0 | 0 | 0 |
| | PIXEL 4 | 0 | + | + | + | + | + | 0 | 0 | 0 | - | - | - | - | - | + | + | + | + | + | 0 | 0 | 0 | - | - | - | - | - | + | + | + | + | + | 0 | 0 | 0 |
| REMAINDER FREQUENCY MEMORY R(j,i) | PIXEL 1 | 0 | 5 | 4 | 3 | 2 | 1 | 0 | 0 | 0 | -5 | -4 | -3 | -2 | -1 | 5 | 4 | 3 | 2 | 1 | 0 | 0 | 0 | -5 | -4 | -3 | -2 | -1 | 5 | 4 | 3 | 2 | 1 | 0 | 0 | 0 |
| | PIXEL 2 | 0 | -5 | -4 | -3 | -2 | -1 | 0 | 0 | 0 | 5 | 4 | 3 | 2 | 1 | -5 | -4 | -3 | -2 | -1 | 0 | 0 | 0 | 5 | 4 | 3 | 2 | 1 | -5 | -4 | -3 | -2 | -1 | 0 | 0 | 0 |
| | PIXEL 3 | 0 | -5 | -4 | -3 | -2 | -1 | 0 | 0 | 0 | 5 | 4 | 3 | 2 | 1 | -5 | -4 | -3 | -2 | -1 | 0 | 0 | 0 | 5 | 4 | 3 | 2 | 1 | -5 | -4 | -3 | -2 | -1 | 0 | 0 | 0 |
| | PIXEL 4 | 0 | 5 | 4 | 3 | 2 | 1 | 0 | 0 | 0 | -5 | -4 | -3 | -2 | -1 | 5 | 4 | 3 | 2 | 1 | 0 | 0 | 0 | -5 | -4 | -3 | -2 | -1 | 5 | 4 | 3 | 2 | 1 | 0 | 0 | 0 |
| FREQUENCY DIFFERENCE MEMORY D(j,i) | PIXEL 1 | -9 | -8 | -7 | -6 | -5 | -4 | -3 | -2 | -1 | -2 | -3 | -4 | -5 | -6 | -5 | -4 | -3 | -2 | -1 | 0 | 1 | 2 | 1 | 0 | -1 | -2 | -3 | -2 | -1 | 0 | 1 | 2 | 3 | 4 | 5 |
| | PIXEL 2 | 11 | 10 | 9 | 8 | 7 | 6 | 5 | 4 | 3 | 4 | 5 | 6 | 7 | 8 | 7 | 6 | 5 | 4 | 3 | 2 | 1 | 0 | 1 | 2 | 3 | 4 | 5 | 4 | 3 | 2 | 1 | 0 | 0 | 0 | 0 |
| | PIXEL 3 | 5 | 4 | 3 | 2 | 1 | 0 | 0 | 0 | 0 | 1 | 2 | 3 | 4 | 5 | 4 | 3 | 2 | 1 | 0 | 0 | 0 | 0 | 1 | 2 | 3 | 4 | 5 | 4 | 3 | 2 | 1 | 0 | 0 | 0 | 0 |
| | PIXEL 4 | 0 | 1 | 2 | 3 | 4 | 5 | 5 | 5 | 5 | 4 | 3 | 2 | 1 | 0 | 1 | 2 | 3 | 4 | 5 | 5 | 5 | 5 | 4 | 3 | 2 | 1 | 0 | 1 | 2 | 3 | 4 | 5 | 5 | 5 | 5 |

FIG. 19A

FRAME NUMBER 60

| | | | | | | | | | | | | | | | | | | | | | | | |
|---|---|---|---|---|---|---|---|---|---|---|---|---|---|---|---|---|---|---|---|---|---|---|---|
| PRESENT MEMORY C(j,i) | PIXEL 1 | 0 | 0 | 0 | 0 | 0 | 1 | 1 | 1 | 1 | 1 | ... | 1 | 1 | 1 | 1 | 1 | 0 | 0 | 0 | 0 | 0 | 0 |
| | PIXEL 2 | 0 | 0 | 0 | 0 | 0 | 1 | 1 | 1 | 1 | 1 | | 1 | 1 | 1 | 1 | 1 | 0 | 0 | 0 | 0 | 0 | 1 |
| | PIXEL 3 | 0 | 0 | 0 | 0 | 0 | 1 | 1 | 1 | 1 | 1 | | 1 | 1 | 1 | 1 | 1 | 0 | 0 | 0 | 0 | 0 | 0 |
| | PIXEL 4 | 0 | 0 | 0 | 0 | 0 | 1 | 1 | 1 | 1 | 1 | | 1 | 1 | 1 | 1 | 1 | 0 | 0 | 0 | 0 | 0 | 1 |
| NEXT MEMORY N(j,i) | PIXEL 1 | 0 | 0 | 0 | 0 | 0 | 0 | 0 | 0 | 0 | 0 | ... | 0 | 0 | 0 | 0 | 0 | 0 | 0 | 0 | 0 | 0 | 0 |
| | PIXEL 2 | 1 | 1 | 1 | 1 | 1 | 1 | 1 | 1 | 1 | 1 | | 1 | 1 | 1 | 1 | 1 | 1 | 1 | 1 | 1 | 1 | 1 |
| | PIXEL 3 | 0 | 0 | 0 | 0 | 0 | 0 | 0 | 0 | 0 | 0 | | 0 | 0 | 0 | 0 | 0 | 0 | 0 | 0 | 0 | 0 | 0 |
| | PIXEL 4 | 1 | 1 | 1 | 1 | 1 | 1 | 1 | 1 | 1 | 1 | | 1 | 1 | 1 | 1 | 1 | 1 | 1 | 1 | 1 | 1 | 1 |
| OPTICAL STATE H | PIXEL 1 | 5 | 5 | 5 | 5 | 5 | 4 | 3 | 2 | 1 | 0 | ... | 4 | 3 | 2 | 1 | 0 | 0 | 0 | 0 | 0 | 0 | 0 |
| | PIXEL 2 | 1 | 4 | 5 | 5 | 5 | 4 | 3 | 2 | 1 | 0 | | 4 | 3 | 2 | 1 | 0 | 1 | 4 | 5 | 5 | 5 | 5 |
| | PIXEL 3 | 1 | 4 | 5 | 5 | 5 | 4 | 3 | 2 | 1 | 0 | | 4 | 3 | 2 | 1 | 0 | 0 | 0 | 0 | 0 | 0 | 0 |
| | PIXEL 4 | 5 | 5 | 5 | 5 | 5 | 4 | 3 | 2 | 1 | 0 | | 4 | 3 | 2 | 1 | 0 | 1 | 4 | 5 | 5 | 5 | 5 |
| APPLIED VOLTAGE V | PIXEL 1 | 0 | 0 | 0 | 0 | 0 | - | - | - | - | - | ... | - | - | - | - | - | 0 | 0 | 0 | 0 | 0 | 0 |
| | PIXEL 2 | + | + | + | + | + | - | - | - | - | - | | - | - | - | - | - | + | + | + | + | + | 0 |
| | PIXEL 3 | + | + | + | + | + | - | - | - | - | - | | - | - | - | - | - | 0 | 0 | 0 | 0 | 0 | 0 |
| | PIXEL 4 | 0 | 0 | 0 | 0 | 0 | - | - | - | - | - | | - | - | - | - | - | + | + | + | + | + | 0 |
| REMAINDER FREQUENCY MEMORY R(j,i) | PIXEL 1 | 0 | 0 | 0 | 0 | 0 | -5 | -4 | -3 | -2 | -1 | ... | -5 | -4 | -3 | -2 | -1 | 0 | 0 | 0 | 0 | 0 | 0 |
| | PIXEL 2 | 5 | 4 | 3 | 2 | 1 | -5 | -4 | -3 | -2 | -1 | | -5 | -4 | -3 | -2 | -1 | 5 | 4 | 3 | 2 | 1 | 0 |
| | PIXEL 3 | 5 | 4 | 3 | 2 | 1 | -5 | -4 | -3 | -2 | -1 | | -5 | -4 | -3 | -2 | -1 | 0 | 0 | 0 | 0 | 0 | 0 |
| | PIXEL 4 | 0 | 0 | 0 | 0 | 0 | -5 | -4 | -3 | -2 | -1 | | -5 | -4 | -3 | -2 | -1 | 5 | 4 | 3 | 2 | 1 | 0 |
| FREQUENCY DIFFERENCE MEMORY D(j,i) | PIXEL 1 | 5 | 5 | 5 | 5 | 5 | 4 | 3 | 2 | 1 | 0 | ... | 4 | 3 | 2 | 1 | 0 | 0 | 0 | 0 | 0 | 0 | 0 |
| | PIXEL 2 | 1 | 2 | 3 | 4 | 5 | 4 | 3 | 2 | 1 | 0 | | 4 | 3 | 2 | 1 | 0 | 1 | 2 | 3 | 4 | 5 | 5 |
| | PIXEL 3 | 5 | 5 | 5 | 5 | 5 | 4 | 3 | 2 | 1 | 0 | | 4 | 3 | 2 | 1 | 0 | 0 | 0 | 0 | 0 | 0 | 0 |
| | PIXEL 4 | 1 | 2 | 3 | 4 | 5 | 4 | 3 | 2 | 1 | 0 | | 4 | 3 | 2 | 1 | 0 | 1 | 2 | 3 | 4 | 5 | 5 |

FIG. 19B

| FRAME NUMBER | | 0 | | | | | 5 | | | | | 10 | | | | | 15 | | | | | 20 | | | | | 25 | | | | | 30 |
|---|---|---|---|---|---|---|---|---|---|---|---|---|---|---|---|---|---|---|---|---|---|---|---|---|---|---|---|---|---|---|---|---|
| PRESENT MEMORY C(j,i) | PIXEL 1 | 0 | 0 | 0 | 0 | 1 | 1 | 1 | 1 | 1 | 1 | 0 | 0 | 0 | 0 | 0 | 0 | 1 | 1 | 1 | 1 | 1 | 1 | 0 | 0 | 0 | 0 | 0 | 0 | 1 | 1 | 1 |
| | PIXEL 2 | 1 | 1 | 1 | 1 | 1 | 1 | 1 | 1 | 1 | 1 | 0 | 0 | 0 | 0 | 0 | 0 | 1 | 1 | 1 | 1 | 1 | 1 | 0 | 0 | 0 | 0 | 0 | 0 | 1 | 1 | 1 |
| | PIXEL 3 | 1 | 1 | 1 | 1 | 1 | 1 | 1 | 1 | 1 | 1 | 0 | 0 | 0 | 0 | 0 | 0 | 1 | 1 | 1 | 1 | 1 | 1 | 0 | 0 | 0 | 0 | 0 | 0 | 1 | 1 | 1 |
| | PIXEL 4 | 0 | 0 | 0 | 0 | 1 | 1 | 1 | 1 | 1 | 1 | 0 | 0 | 0 | 0 | 0 | 0 | 1 | 1 | 1 | 1 | 1 | 1 | 0 | 0 | 0 | 0 | 0 | 0 | 1 | 1 | 1 |
| NEXT MEMORY N(j,i) | PIXEL 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | PIXEL 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | PIXEL 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | PIXEL 4 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| OPTICAL STATE H | PIXEL 1 | 4 | 5 | 5 | 5 | 5 | 5 | 5 | 4 | 3 | 2 | 2 | 2 | 2 | 4 | 5 | 5 | 5 | 5 | 5 | 4 | 3 | 2 | 2 | 2 | 2 | 4 | 5 | 5 | 5 | 5 | 5 |
| | PIXEL 2 | 5 | 5 | 5 | 5 | 5 | 5 | 5 | 4 | 3 | 2 | 1 | 0 | 0 | 1 | 4 | 5 | 5 | 5 | 5 | 4 | 3 | 2 | 1 | 0 | 0 | 1 | 4 | 5 | 5 | 5 | 5 |
| | PIXEL 3 | 5 | 5 | 5 | 5 | 5 | 5 | 5 | 4 | 3 | 2 | 2 | 2 | 2 | 4 | 5 | 5 | 5 | 5 | 5 | 4 | 3 | 2 | 2 | 2 | 2 | 4 | 5 | 5 | 5 | 5 | 5 |
| | PIXEL 4 | 4 | 5 | 5 | 5 | 5 | 5 | 5 | 4 | 3 | 2 | 2 | 2 | 2 | 4 | 5 | 5 | 5 | 5 | 5 | 4 | 3 | 2 | 2 | 2 | 2 | 4 | 5 | 5 | 5 | 5 | 5 |
| APPLIED VOLTAGE V | PIXEL 1 | 0 | + | + | + | + | + | + | - | - | - | 0 | 0 | 0 | + | + | + | + | + | + | - | - | - | 0 | 0 | 0 | + | + | + | + | + | + |
| | PIXEL 2 | 0 | 0 | 0 | 0 | 0 | 0 | 0 | - | - | - | - | - | - | + | + | + | 0 | 0 | 0 | - | - | - | - | - | - | + | + | + | 0 | 0 | 0 |
| | PIXEL 3 | 0 | 0 | 0 | 0 | 0 | 0 | 0 | - | - | - | 0 | 0 | 0 | + | + | + | 0 | 0 | 0 | - | - | - | 0 | 0 | 0 | + | + | + | 0 | 0 | 0 |
| | PIXEL 4 | 0 | + | + | + | 0 | 0 | 0 | - | - | - | 0 | 0 | 0 | + | + | + | 0 | 0 | 0 | - | - | - | 0 | 0 | 0 | + | + | + | 0 | 0 | 0 |
| REMAINDER FREQUENCY MEMORY R(j,i) | PIXEL 1 | 0 | 3 | 2 | 1 | 0 | 0 | 0 | -3 | -2 | -1 | 0 | 0 | 0 | 3 | 2 | 1 | 0 | 0 | 0 | -3 | -2 | -1 | 0 | 0 | 0 | 3 | 2 | 1 | 0 | 0 | 0 |
| | PIXEL 2 | 0 | 0 | 0 | 0 | 0 | 0 | 0 | -3 | -2 | -1 | 0 | 0 | 0 | 3 | 2 | 1 | 0 | 0 | 0 | -3 | -2 | -1 | 0 | 0 | 0 | 3 | 2 | 1 | 0 | 0 | 0 |
| | PIXEL 3 | 0 | 0 | 0 | 0 | 0 | 0 | 0 | -3 | -2 | -1 | 0 | 0 | 0 | 3 | 2 | 1 | 0 | 0 | 0 | -3 | -2 | -1 | 0 | 0 | 0 | 3 | 2 | 1 | 0 | 0 | 0 |
| | PIXEL 4 | 0 | 3 | 2 | 1 | 0 | 0 | 0 | -3 | -2 | -1 | 0 | 0 | 0 | 3 | 2 | 1 | 0 | 0 | 0 | -3 | -2 | -1 | 0 | 0 | 0 | 3 | 2 | 1 | 0 | 0 | 0 |
| FREQUENCY DIFFERENCE MEMORY D(j,i) | PIXEL 1 | -7 | -6 | -5 | -4 | -3 | -2 | -1 | -2 | -3 | -4 | -4 | -4 | -4 | -3 | -2 | -1 | 0 | 1 | 2 | 1 | 0 | -1 | -1 | -1 | -1 | 0 | 1 | 2 | 3 | 4 | 5 |
| | PIXEL 2 | 11 | 11 | 11 | 11 | 11 | 11 | 11 | 10 | 9 | 8 | 7 | 6 | 5 | 6 | 7 | 8 | 8 | 8 | 8 | 7 | 6 | 5 | 4 | 3 | 2 | 3 | 4 | 5 | 5 | 5 | 5 |
| | PIXEL 3 | 5 | 5 | 5 | 5 | 5 | 5 | 5 | 4 | 3 | 2 | 2 | 2 | 2 | 3 | 4 | 5 | 5 | 5 | 5 | 4 | 3 | 2 | 2 | 2 | 2 | 3 | 4 | 5 | 5 | 5 | 5 |
| | PIXEL 4 | 2 | 3 | 4 | 5 | 5 | 5 | 5 | 4 | 3 | 2 | 2 | 2 | 2 | 3 | 4 | 5 | 5 | 5 | 5 | 4 | 3 | 2 | 2 | 2 | 2 | 3 | 4 | 5 | 5 | 5 | 5 |

FIG. 20A

| FRAME NUMBER | | 35 | | | | | | | | | | | | | | | | | |
|---|---|---|---|---|---|---|---|---|---|---|---|---|---|---|---|---|---|---|---|
| PRESENT MEMORY C(j,i) | PIXEL 1 | 1 | 1 | 1 | 1 | 1 | ... | 1 | 1 | 1 | 1 | 1 | 0 | 0 | 0 | 0 | 0 | 0 |
| | PIXEL 2 | 1 | 1 | 1 | 1 | 1 | | 1 | 1 | 1 | 1 | 1 | 0 | 0 | 0 | 0 | 0 | 1 |
| | PIXEL 3 | 1 | 1 | 1 | 1 | 1 | | 1 | 1 | 1 | 1 | 1 | 0 | 0 | 0 | 0 | 0 | 0 |
| | PIXEL 4 | 1 | 1 | 1 | 1 | 1 | | 1 | 1 | 1 | 1 | 1 | 0 | 0 | 0 | 0 | 0 | 1 |
| NEXT MEMORY N(j,i) | PIXEL 1 | 0 | 0 | 0 | 0 | 0 | ... | 0 | 0 | 0 | 0 | 0 | 0 | 0 | 0 | 0 | 0 | 0 |
| | PIXEL 2 | 1 | 1 | 1 | 1 | 1 | | 1 | 1 | 1 | 1 | 1 | 1 | 1 | 1 | 1 | 1 | 1 |
| | PIXEL 3 | 0 | 0 | 0 | 0 | 0 | | 0 | 0 | 0 | 0 | 0 | 0 | 0 | 0 | 0 | 0 | 0 |
| | PIXEL 4 | 1 | 1 | 1 | 1 | 1 | | 1 | 1 | 1 | 1 | 1 | 1 | 1 | 1 | 1 | 1 | 1 |
| OPTICAL STATE H | PIXEL 1 | 4 | 3 | 2 | 1 | 0 | ... | 4 | 3 | 2 | 1 | 0 | 0 | 0 | 0 | 0 | 0 | 0 |
| | PIXEL 2 | 4 | 3 | 2 | 1 | 0 | | 4 | 3 | 2 | 1 | 0 | 1 | 4 | 5 | 5 | 5 | 5 |
| | PIXEL 3 | 4 | 3 | 2 | 1 | 0 | | 4 | 3 | 2 | 1 | 0 | 0 | 0 | 0 | 0 | 0 | 0 |
| | PIXEL 4 | 4 | 3 | 2 | 1 | 0 | | 4 | 3 | 2 | 1 | 0 | 1 | 4 | 5 | 5 | 5 | 5 |
| APPLIED VOLTAGE V | PIXEL 1 | - | - | - | - | - | ... | - | - | - | - | - | 0 | 0 | 0 | 0 | 0 | 0 |
| | PIXEL 2 | - | - | - | - | - | | - | - | - | - | - | + | + | + | + | + | 0 |
| | PIXEL 3 | - | - | - | - | - | | - | - | - | - | - | 0 | 0 | 0 | 0 | 0 | 0 |
| | PIXEL 4 | - | - | - | - | - | | - | - | - | - | - | + | + | + | + | + | 0 |
| REMAINDER FREQUENCY MEMORY R(j,i) | PIXEL 1 | -5 | -4 | -3 | -2 | -1 | ... | -5 | -4 | -3 | -2 | -1 | 0 | 0 | 0 | 0 | 0 | 0 |
| | PIXEL 2 | -5 | -4 | -3 | -2 | -1 | | -5 | -4 | -3 | -2 | -1 | 5 | 4 | 3 | 2 | 1 | 0 |
| | PIXEL 3 | -5 | -4 | -3 | -2 | -1 | | -5 | -4 | -3 | -2 | -1 | 0 | 0 | 0 | 0 | 0 | 0 |
| | PIXEL 4 | -5 | -4 | -3 | -2 | -1 | | -5 | -4 | -3 | -2 | -1 | 5 | 4 | 3 | 2 | 1 | 0 |
| FREQUENCY DIFFERENCE MEMORY D(j,i) | PIXEL 1 | 4 | 3 | 2 | 1 | 0 | ... | 4 | 3 | 2 | 1 | 0 | 0 | 0 | 0 | 0 | 0 | 0 |
| | PIXEL 2 | 4 | 3 | 2 | 1 | 0 | | 4 | 3 | 2 | 1 | 0 | 1 | 2 | 3 | 4 | 5 | 5 |
| | PIXEL 3 | 4 | 3 | 2 | 1 | 0 | | 4 | 3 | 2 | 1 | 0 | 0 | 0 | 0 | 0 | 0 | 0 |
| | PIXEL 4 | 4 | 3 | 2 | 1 | 0 | | 4 | 3 | 2 | 1 | 0 | 1 | 2 | 3 | 4 | 5 | 5 |

FIG. 20B

| FRAME NUMBER | | 0 | | | | | 5 | | | | 10 | | | | 15 | | | | | 20 | | | | | 25 | | | | | | | 30 | | | | | 35 |
|---|---|---|---|---|---|---|---|---|---|---|---|---|---|---|---|---|---|---|---|---|---|---|---|---|---|---|---|---|---|---|---|---|---|---|---|---|---|
| PRESENT MEMORY C(j,i) | PIXEL 1 | 0 | 0 | 0 | 0 | 0 | 0 | 1 | 1 | 1 | 1 | 1 | 1 | 1 | 1 | 1 | 1 | 1 | 1 | 0 | 0 | 0 | 0 | 0 | 1 | 1 | 1 | 1 | 1 | 1 | 1 | 1 | 1 | 1 | 1 | 1 | 1 | 1 |
| | PIXEL 2 | 1 | 1 | 1 | 1 | 1 | 1 | 1 | 1 | 1 | 1 | 1 | 1 | 1 | 1 | 1 | 1 | 1 | 1 | 0 | 0 | 0 | 0 | 0 | 1 | 1 | 1 | 1 | 1 | 1 | 1 | 1 | 1 | 1 | 1 | 1 | 1 | 0 |
| NEXT MEMORY N(j,i) | PIXEL 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| | PIXEL 2 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| OPTICAL STATE H | PIXEL 1 | 0 | 1 | 4 | 5 | 5 | 5 | 5 | 5 | 5 | 5 | 5 | 5 | 4 | 3 | 2 | 1 | 0 | 0 | 1 | 4 | 5 | 5 | 5 | 5 | 5 | 5 | 5 | 5 | 5 | 5 | 5 | 5 | 5 | 5 | 5 | 5 | 5 |
| | PIXEL 2 | 5 | 5 | 5 | 5 | 5 | 5 | 5 | 5 | 5 | 5 | 5 | 5 | 4 | 3 | 2 | 1 | 0 | 0 | 1 | 4 | 5 | 5 | 5 | 5 | 5 | 5 | 5 | 5 | 5 | 5 | 4 | 3 | 2 | 1 | 0 | 0 | 0 |
| APPLIED VOLTAGE V | PIXEL 1 | 0 | + | + | + | + | + | + | + | + | + | + | + | - | - | - | - | - | + | + | + | + | + | + | + | + | + | + | + | + | + | + | 0 | 0 | 0 | 0 | 0 | 0 |
| | PIXEL 2 | 0 | + | + | 0 | 0 | 0 | 0 | 0 | 0 | 0 | 0 | 0 | - | - | - | - | - | + | + | + | + | + | + | + | + | + | + | + | + | + | + | - | - | - | - | - | 0 |
| REMAINDER FREQUENCY MEMORY R(j,i) | PIXEL 1 | 0 | 5 | 4 | 3 | 2 | 1 | 0 | 0 | 0 | 0 | 0 | 0 | -5 | -4 | -3 | -2 | -1 | 5 | 4 | 3 | 2 | 1 | 0 | 0 | 0 | 0 | 0 | 0 | 0 | 0 | 0 | 0 | 0 | 0 | 0 | 0 | 0 |
| | PIXEL 2 | 0 | 0 | 0 | 0 | 0 | 0 | 0 | 0 | 0 | 0 | 0 | 0 | -5 | -4 | -3 | -2 | -1 | 5 | 4 | 3 | 2 | 1 | 0 | 0 | 0 | 0 | 0 | 0 | 0 | 0 | -5 | -4 | -3 | -2 | -1 | 0 |
| FREQUENCY DIFFERENCE MEMORY D(j,i) | PIXEL 1 | -6 | -5 | -4 | -3 | -2 | -1 | 0 | 1 | 2 | 3 | 4 | 5 | 4 | 3 | 2 | 1 | 0 | 1 | 2 | 3 | 4 | 5 | 6 | 7 | 8 | 9 | 10 | 11 | 12 | 13 | 13 | 13 | 13 | 13 | 13 | 13 |
| | PIXEL 2 | 3 | 4 | 5 | 5 | 5 | 5 | 5 | 5 | 5 | 5 | 5 | 5 | 4 | 3 | 2 | 1 | 0 | 1 | 2 | 3 | 4 | 5 | 6 | 7 | 8 | 9 | 10 | 11 | 12 | 13 | 12 | 11 | 10 | 9 | 8 | 8 |

FIG. 21

CONTROL DEVICE, ELECTROOPTICS DEVICE, ELECTRONIC EQUIPMENT, AND CONTROL METHOD

BACKGROUND

1. Technical Field

The present invention relates to the technology that controls an electro-optic device in which an image can be written by voltage application multiple times.

2. Related Art

Display devices such as electrophoretic display devices may rewrite an image using plural frames. Such rewriting operation is performed when the display element requires a relatively long time to change its display state (i.e., the gray level). When such rewriting is performed, the display element cannot begin the following rewriting unless one set of rewriting is completed (in other words, unless the time for the plural frames passes).

Japanese Laid-open Patent Application 2009-251615 (Patent Document 1) describes a technology to rewrite an image in the unit of a partial area by performing pipeline processing in a display device such as an electrophoretic display device. According to this technology, for an area where rewriting is not being executed, rewriting of that area can be started without depending on rewriting of other areas, and the time required for rewriting may be shortened, compared with the case where the entire image is rewritten.

In the case of the technology described in Patent Document 1, to rewrite plural areas in parallel, pipelines are necessary for the number of the areas. In other words, the number of areas that can be rewritten in parallel is limited by the number of pipelines in the technology described in Patent Document 1. Moreover, in the technology described in Patent Document 1, when a certain area to be rewritten and another area overlap each other, rewriting of the other area cannot be started until after the present rewriting of the area to be rewritten is completed.

SUMMARY

In accordance with some aspects of the invention, in a display device that rewrites an image by voltage application multiple times, a technology that improves the apparent rewriting speed felt by the user can be provided.

A control device in accordance with an embodiment of the invention includes: a memory control device that controls access, for each of plural pixels whose gray level changes from a first gray level to a second gray level by voltage application multiple times in a predetermined period as the unit, to a first memory that stores a present gray level value, a second memory that stores a gray level value to be displayed next, a third memory that stores a remainder frequency of voltage applications, and a fourth memory that stores a difference between the frequency of applications of a first voltage by which the pixel is changed to the first gray level and the frequency of applications of a second voltage by which the pixel is changed to the second gray level; and a drive control device that controls, for a target pixel to be processed among the plural pixels, to apply a voltage to the target pixel, when the gray level value stored in the first memory and the gray level value stored in the second memory are mutually different, and the remainder frequency stored in the third memory is not zero. When, for the target pixel, a comparison result between the gray level value stored in the first memory and the gray level value stored in the second memory and the remainder frequency stored in the third memory meet a predetermined condition, the drive control device performs a cleanup processing that includes rewriting the remainder frequency to a set value decided according to the gray level value stored in the second memory, and displaying a predetermined image at the plural pixels with a predetermined timing. The cleanup processing includes an adjustment processing that includes writing an adjustment image to the multiple pixels by voltage application thereto until the difference meets a predetermined end condition. According to the control device described above, the apparent rewriting speed felt by the user can be improved in the display device that rewrites an image by voltage application multiple times, compared with a composition in which a rewriting operation in an area to be newly rewritten starts after the ongoing rewriting operation is completed.

In accordance with a preferred embodiment, the adjustment image may include a first image in which the gray level of all pixels of the plural pixels is the first gray level, and a second image in which the gray level of all pixels of the plural pixels is the second gray level. The end condition may be a condition in which, in the first image, the minimum value of the difference stored in the fourth memory is more than a first reference value decided according to the first gray level, and in the second image, the maximum value of the difference stored in the fourth memory is less than a second reference value decided according to the second gray level. According to the control device, the frequency difference can be adjusted to a predetermined state.

In accordance with another preferred embodiment, the adjustment image may include a first image expressed by a gray level value that is an inversion of the gray level value stored in the second memory, and a second image expressed by the gray level value stored in the second memory. The end condition may be a condition in which, in the first image, for a pixel whose gray level value stored in the second memory is a first gray level, the difference stored in the fourth memory is more than a second reference value decided according to the second gray level, and for a pixel whose gray level value stored in the second memory is a second gray level, the difference stored in the fourth memory is less than a first reference value decided according to the first gray level; and in the second image, for a pixel whose gray level value stored in the second memory is a first gray level, the difference stored in the fourth memory is the first reference value, and for a pixel whose gray level value stored in the second memory is a second gray level, the difference stored in the fourth memory is the second reference value. According to the control device, the frequency difference can be adjusted to a predetermined state.

In accordance with a preferred embodiment, the adjustment image may include a first image expressed by a gray level value that is an inversion of the gray level value stored in the first memory, and the end condition may be a condition in which, in the first image, for a pixel whose gray level value stored in the first memory is the first gray level, the difference stored in the fourth memory is less than a first reference value decided according to the first gray level; and for a pixel whose gray level value stored in the first memory is the second gray level, the difference stored in the fourth memory is more than a second reference value decided according to the second gray level. According to the control device, the frequency difference can be adjusted to a predetermined state.

In accordance with still another preferred embodiment, the adjustment image may include a first image in which the gray level of all pixels of the plural pixels indicates a gray level value stored in the first memory, a second image in which the gray level of all pixels of the plural pixels is the second gray level, and a third image in which the gray level of all pixels of the plural pixels is the first gray level. The end condition may be a condition in which, in the first image, for a pixel whose gray level value stored in the second memory is a first gray level, the difference stored in the fourth memory is a first reference value decided according to the first gray level, and for a pixel whose gray level value stored in the second memory is a second gray level, the difference stored in the fourth memory is a second reference value decided according to the second gray level; a condition in which, in the second image, the difference for all pixels is the second reference value; and a condition in which, in the third image, the difference for all pixels is the first reference value. According to the control device, the frequency difference can be adjusted to a predetermined state.

In accordance with yet another preferred embodiment, the adjustment image may include a first image in which the gray level of all pixels of the plural pixels indicates a gray level value stored in the first memory, and a second image in which the gray level of all pixels of the plural pixels is the second gray level. The end condition may be a condition in which, in the first image, for all pixels in the plural pixels, the difference stored in the fourth memory is a first reference value decided according to the first gray level; and a condition in which, in the second image, for all pixels in the plural pixels, the difference stored in the fourth memory is a second reference value decided according to the second gray level. According to the control device, the frequency difference can be adjusted to a predetermined state.

In accordance with another preferred embodiment, the adjustment image may include a first image that indicates the first gray level for a pixel in which the difference stored in the fourth memory is less than a first reference value decided according to the first gray level and greater than the minimum value of the difference and indicates the second gray level for a pixel in which the difference is greater than the first reference value and less than the maximum value of the difference, a second image in which the gray level of all pixels of the plural pixels is the first gray level, and a third image in which the gray level of all pixels of the plural pixels is the second gray level. The end condition may be a condition in which, in the first image, for a pixel in which the difference stored in the fourth memory is less than the first reference value, the difference is the minimum value, and for a pixel in which the difference stored in the fourth memory is greater than the first reference value, the difference is the maximum value; a condition in which, in the second image, the maximum value of the difference stored in the fourth memory is less than the first reference value; and a condition in which, in the third image, the minimum value of the difference stored in the fourth memory is less than the second reference value. According to the control device, the frequency difference can be adjusted to a predetermined state.

In accordance with still another preferred embodiment, the end condition may be a condition in which a pixel in which the difference stored in the fourth memory is a first reference value decided according to the first gray level and a pixel in which the difference is a second reference value decided according to the second gray level are alternately disposed. According to the control device, the frequency difference can be adjusted to a predetermined state.

In accordance with another preferred embodiment, the end condition may further include a condition in which writing of an identical image is continuously executed a predetermined number of times. According to the control device, the frequency difference can be adjusted to a predetermined state when a different image is set in the case where rewriting of an identical image is continuously executed a predetermined number of times.

In accordance with another preferred embodiment, each of the plural pixels may change from the first gray level to the second gray level by voltage application a times, and from the second gray level to the first gray level by voltage application b times, and when the drive control device writes the adjustment image, the memory control device writes a remainder frequency smaller than the a times to the third memory for a pixel that is changed from the first gray level to the second gray level, and writes a remainder frequency smaller than the b times to the third memory for a pixel that is changed from the second gray level to the first gray level. According to the control device, the frequency difference can be adjusted to a predetermined state, using an image that is difficult to be visually recognized.

In accordance with another preferred embodiment, each of the plural pixels may change from the first gray level to the second gray level by voltage application a times, and from the second gray level to the first gray level by voltage application b times, and a difference between the first reference value and the second reference value is equal to a larger one of the a and the b. According to the control device, the frequency difference can be adjusted to a predetermined state, when the difference between the first reference value and the second reference value is equal to a larger one of the a and the b.

In accordance with another preferred embodiment, each of the plural pixels may change from the first gray level to the second gray level by voltage application a times, and from the second gray level to the first gray level by voltage application b times, and a second difference between a larger frequency of the a and the b and a first difference between a first reference value decided according to the first gray level and a second reference value decided according to the second gray level is less than a threshold value. According to the control device, the frequency difference can be adjusted to a predetermined state, when the second difference is less than a threshold value.

In accordance with another preferred embodiment, the drive control device may further apply the second voltage a predetermined number of times, in the cleanup processing, after the adjustment processing, when the gray level of each of the pixels is the second gray level. According to the control device, an offset can be applied to the frequency difference.

In accordance with another preferred embodiment, the predetermined image may include an image in which the gray level of each pixel is the first gray level and a picture in which the gray level of each pixel is the second gray level. According to the control device, the state of the electro-optic element can be initialized.

In accordance with another embodiment of the invention, an electro-optic device having any one of the control devices described above and the plural pixels is provided. According to the electro-optic device described above, the apparent rewriting speed felt by the user can be improved in the display device that rewrites an image by voltage application multiple times, compared with the composition in which a rewriting operation in an area to be newly rewritten starts after the ongoing rewriting operation is completed.

In accordance with another embodiment of the invention, an electronic apparatus having the electro-optic device described above is provided. According to the electronic apparatus, the apparent rewriting speed felt by the user can be improved in the display device that rewrites an image by voltage application multiple times, compared with the composition in which a rewriting operation in an area to be newly rewritten starts after the ongoing rewriting operation is completed.

Another embodiment of the invention pertains to a control method for controlling an electro-optic device having a plurality of pixels whose gray level changes from a first gray level to a second gray level by voltage application multiple times in a predetermined period as the unit, a control device, a first memory that stores a present gray level value, a second memory that stores a gray level value to be displayed next, a third memory that stores a remainder frequency of voltage applications, and a fourth memory that stores a difference between the frequency of applications of a first voltage by which the pixel is changed to the first gray level and the frequency of applications of a second voltage by which the pixel is changed to the second gray level. The control method includes a processing performed by the control device, for a target pixel to be processed among the plural pixels when the remainder frequency stored in the third memory has a value other than zero, of rewriting the remainder frequency to a set value decided according to the gray level value stored in the second memory, and performing a cleanup processing that includes an adjustment processing of rewriting a present image to an adjustment image with a predetermined timing and displaying a predetermined image. In the adjustment processing, the control device performs voltage application for a pixel having the difference other than a predetermined value, until the difference is contained within a predetermined range with respect to a predetermined value, thereby rewriting the present image to a gray level different from the present gray level. According to the control method described above, the apparent rewriting speed felt by the user can be improved in the display device that rewrites an image by voltage application multiple times, compared with the composition in which a rewriting operation in an area to be newly rewritten starts after the ongoing rewriting operation is completed.

BRIEF DESCRIPTION OF THE DRAWINGS

FIG. 8 shows tables exemplifying changes in data with the passage of time stored in storage areas.

FIG. 12 shows tables exemplifying changes in data with the passage of time in each storage area in accordance with a processing example 1.

FIG. 13 shows tables exemplifying changes in data with the passage of time in each storage area in accordance with a processing example 2.

FIG. 14 shows tables exemplifying changes in data with the passage of time in each storage area in accordance with a processing example 3.

FIG. 15 shows tables exemplifying changes in data with the passage of time in each storage area in accordance with a processing example 4.

FIG. 16A shows tables exemplifying changes in data with the passage of time in each storage area in accordance with a processing example 5.

FIG. 16B shows tables exemplifying changes in data with the passage of time in each storage area in accordance with a processing example 5.

FIG. 17A shows tables exemplifying changes in data with the passage of time in each storage area in accordance with a processing example 6.

FIG. 17B shows tables exemplifying changes in data with the passage of time in each storage area in accordance with a processing example 6.

FIG. 18 shows tables exemplifying changes in data with the passage of time in each storage area in accordance with a processing example 7.

FIG. 19A shows tables exemplifying changes in data with the passage of time in each storage area in accordance with a processing example 8.

FIG. 19B shows tables exemplifying changes in data with the passage of time in each storage area in accordance with a processing example 8.

FIG. 20A shows tables exemplifying changes in data with the passage of time in each storage area in accordance with a processing example 9.

FIG. 20B shows tables exemplifying changes in data with the passage of time in each storage area in accordance with a processing example 9.

FIG. 21 shows tables exemplifying changes in data with the passage of time in each storage area in accordance with a modification example 3.

DESCRIPTION OF EXEMPLARY EMBODIMENTS

1. Configuration

Figure 1:
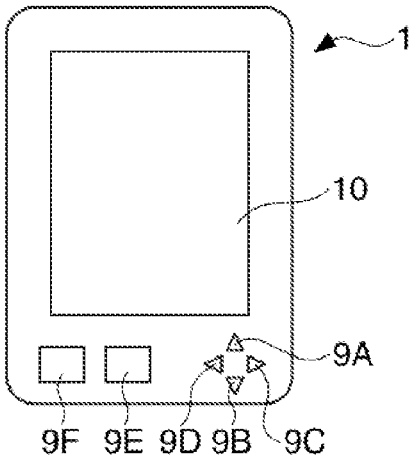
FIG. 1 is a schematic front view of the external appearance of an electronic apparatus 1 in accordance with an embodiment.

FIG. 1 is a schematic front view of the external appearance of an electronic apparatus 1 in accordance with an embodiment. The electronic apparatus 1 is a display apparatus that displays images. In this example, the electronic apparatus 1 is a device for reading electronic books, in other words, an electronic book reader. An electronic book is composed of data including images of a plurality of pages. The electronic apparatus 1 displays the electronic book in a display part 10 by a certain unit (for instance, one page by one page). Among plural pages included in the electronic book, a target one page to be displayed is called a "selection page." The selection page is changed according to the operation of buttons 9A-9F by the user. In other words, the user can turn over the pages (turn the pages forward or backward) of the electronic book by operating the buttons 9A-9F.

Figure 2:
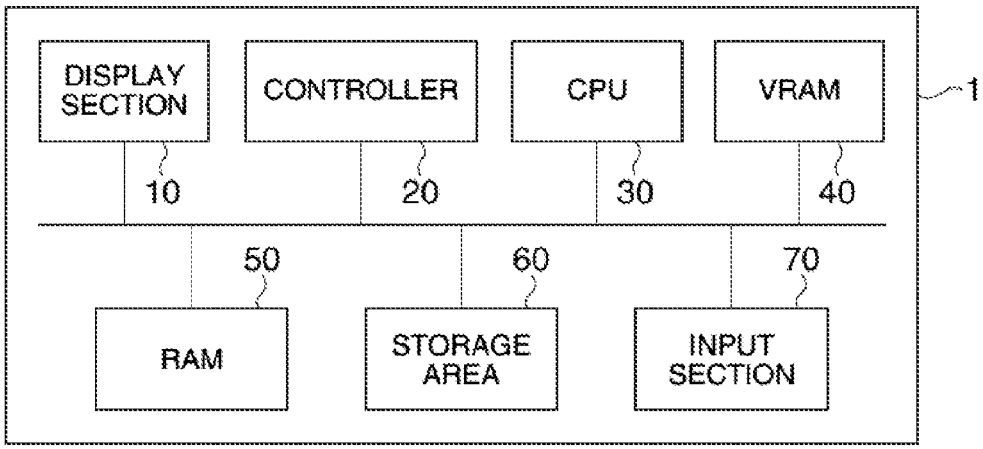
FIG. 2 is a block diagram of the hardware configuration of an electronic apparatus 1.

FIG. 2 is a block diagram of a hardware configuration of the electronic apparatus 1. The electronic apparatus 1 includes a display section 10, a controller 20, a CPU (Central Processing Unit) 30, a VRAM (Video Random Access Memory) 40, a RAM (Random Access Memory) 50, a storage section 60, and an input section 70. The display section 10 has a display panel including display elements for displaying an image. In this example, the display section 10 includes display elements using electrophoretic particles, as display elements having the memory-property that retains a display state without supplying energy through voltage application or the like. The display section 10 displays an image in monochrome multiple gray level levels (in this example, two gray level levels of black and white) with the display elements. The controller 20 controls the display section 10. The CPU 30 is a device that controls each of the sections of the electronic apparatus 1. The CPU 30 uses the RAM 50 as a work area, and executes a program stored in a ROM (Read Only Memory, not shown) or the storage section 60. The VRAM 40 is a memory that stores image data indicative of an image to be displayed on the display section 10. The RAM 50 is a volatile memory that stores data. The storage section 60 is a storage device that stores various data and application programs, in addition to data of electronic books (book data), and includes an HDD (Hard Disk Drive) or a nonvolatile memory such as a flash memory. The storage section 60 is capable of storing data of a plurality of electronic books. The input section 70 is an input device for inputting user's instructions, and includes, for example, a touch screen, key pads, buttons or the like. The components described above are interconnected through a bus.

Figure 3:
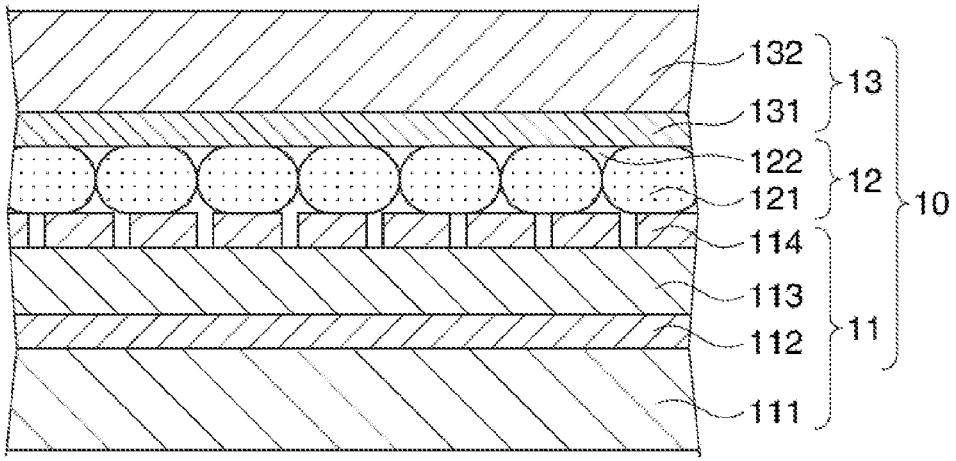
FIG. 3 is a schematic view of a cross-sectional structure of a display section 10.

FIG. 3 is a schematic view of a cross-sectional structure of the display section 10. The display section 10 includes a first substrate 11, an electrophoretic layer 12, and a second substrate 13. The first substrate 11 and the second substrate 13 are substrates for retaining the electrophoretic layer 12.

The first substrate 11 includes a substrate 111, a bonding layer 112 and a circuit layer 113. The substrate 111 is made of a material having dielectric property and flexibility, for example, a polycarbonate substrate. It is noted that the substrate 111 may be made of any resin material that is lightweight, flexible, elastic and dielectric, without any particular limitation to polycarbonate. As another example, the substrate 111 may be formed from glass material without flexibility. The bonding layer 112 is a layer that bonds the substrate 111 and the circuit layer 113 together. The circuit layer 113 is a layer having a circuit for driving the electrophoretic layer 12. The circuit layer 113 has pixel electrodes 114.

The electrophoretic layer 12 includes microcapsules 121 and a binder 122. The microcapsules 121 are fixed by the binder 122. The binder 122 may be made of any material that has good affinity with the microcapsules 121, excellent adhesion to the electrodes, and dielectric property. Each of the microcapsules 121 is a capsule containing a dispersion medium and electrophoretic particles. The microcapsules 121 may preferably be made of a material having flexibility, such as, composites of gum arabic and gelatin, urethane compounds, and the like. It is noted that an adhesive layer made of adhesive may be provided between the microcapsules 121 and the pixel electrodes 114.

As the dispersion medium, it is possible to use any one of materials including water; alcohol solvents (such as, methanol, ethanol, isopropanol, butanol, octanol, and methyl cellosolve); esters (such as, ethyl acetate and butyl acetate); ketones (such as, acetone, methyl ethyl ketone, and methyl isobutyl ketone); aliphatic hydrocarbons (such as, pentane, hexane, and octane); alicyclic hydrocarbons (such as, cyclohexane and methylcyclohexane); aromatic hydrocarbons (such as, benzene, toluene, long-chain alkyl group-containing benzenes (such as, xylenes, hexylbenzene, heptylbenzene, octylbenzene, nonylbenzene, decylbenzene, undecylbenzene, dodecylbenzene, tridecylbenzene, and tetradecylbenzene)); halogenated hydrocarbons (such as, methylene chloride, chloroform, carbon tetrachloride, and 1,2-dichloroethane); and carboxylates. Also, the dispersion medium may be made of any one of other various oils. The dispersion medium may use any of the materials described above in combination, and may be further mixed with a surfactant.

The electrophoretic particles are particles (polymer or colloid) having a property in which the particles move in the dispersion medium by electric fields. In the present embodiment, white electrophoretic particles and black electrophoretic particles are contained in each of the microcapsules 121. The black electrophoretic particles are particles including black pigments, such as, for example, aniline black, carbon black and the like, and are positively charged in the present embodiment. The white electrophoretic particles are particles including white pigment, such as, for example, titanium dioxide, aluminum oxide and the like, and are negatively charged in the present embodiment.

The second substrate 13 includes a common electrode 131 and a film 132. The film 132 seals and protects the electrophoretic layer 12. The film 132 may be formed from a material that is transparent and has a dielectric property, such as, for example, polyethylene terephthalate. The common electrode 131 is made of a transparent conductive material, such as, for example, indium tin oxide (ITO).

Figure 4:
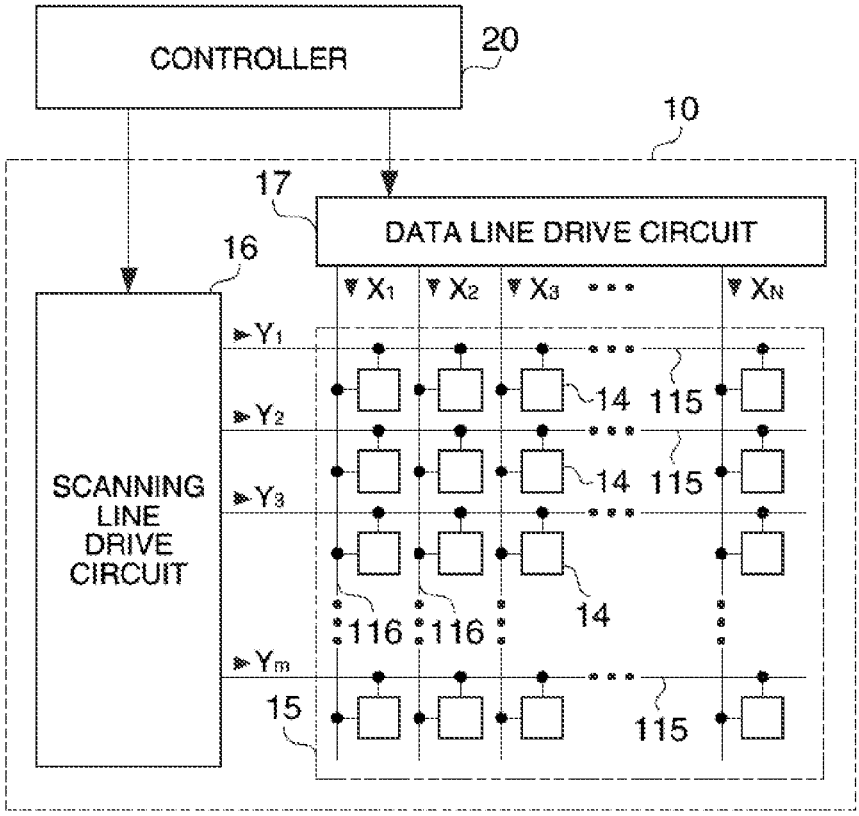
FIG. 4 is a diagram of a circuit configuration of the display section 10.

FIG. 4 is a diagram showing a circuit configuration of the display section 10. The display section 10 and the controller 20 jointly form an electro-optic device. The display section 10 includes m scanning lines 115, n data lines 116, m×n pixels 14, a scanning line drive circuit 16, and a data line drive circuit 17. The scanning line drive circuit 16 and the data line drive circuit 17 are controlled by the controller 20. The scanning lines 115 are arranged along a row direction (x direction), and transmit a scanning signal. The scanning signal is a signal that sequentially, exclusively selects one scanning line 115 from among the m scanning lines 115. The data lines 116 are arranged along a column direction (y direction), and transmit data signals. The data signals are signals indicative of gray level levels of each pixel. The scanning lines 115 are insulated from the data lines 116. The pixels 14 are provided at positions corresponding to intersections between the scanning lines 115 and the data lines 116, and exhibit gray levels according to the respective data signals. It is noted that, when one scanning line 115 among the plurality of scanning lines 115 needs to be distinguished from the others, it is called the scanning line 115 in the first row, the second row, . . . , or the $m^{-th}$ row. The data lines 116 may be similarly distinguished. The m×n pixels 14 form a display region 15. Among the display region 15, when a pixel 14 at the $i^{-th}$ row and the $i^{-th}$ column is to be distinguished from the others, it is referred to as a pixel (j, i). Parameters that have one-to-one correspondence with the pixels 14, such as, gray level values and the like are similarly expressed.

The scanning line drive circuit 16 outputs a scanning signal Y for sequentially, exclusively selecting one scanning line 115 from among the m scanning lines 115. The scanning signal Y is a signal that sequentially, exclusively becomes to be H (High) level. The data line drive circuit 17 outputs data signals X. The data signals X are signals indicative of data voltages corresponding to gray level values of pixels. The data line drive circuit 17 outputs data signals indicative of data voltages corresponding to pixels in a row selected by the scanning signal.

Figure 5:
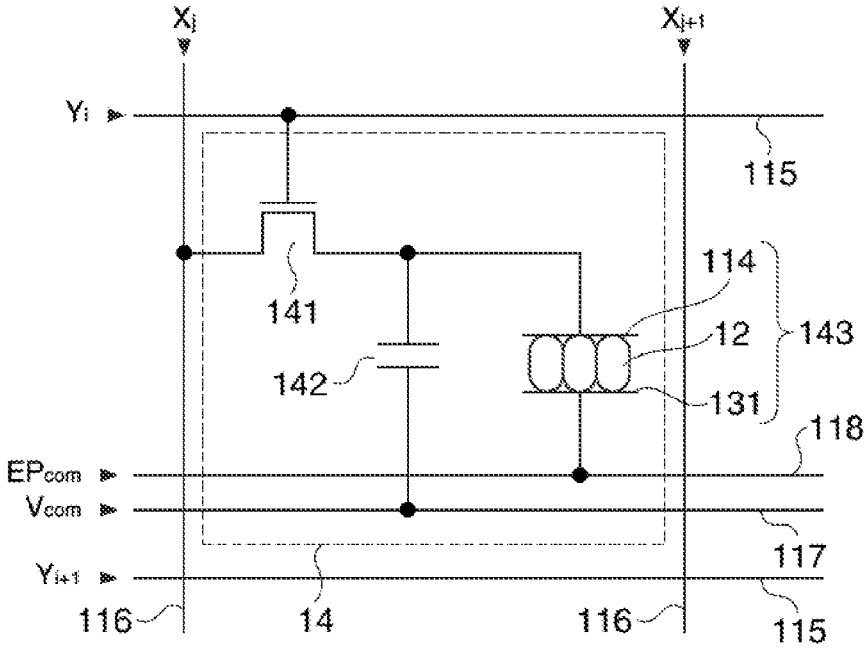
FIG. 5 is a diagram of an equivalent circuit of a pixel 14.

FIG. 5 is a diagram showing an equivalent circuit of the pixel 14. The pixel 14 includes a transistor 141, a capacitance 142, and an electrophoretic element 143. The electrophoretic element 143 includes a pixel electrode 114, an electrophoretic layer 12, and a common electrode 131. The transistor 141 is an example of a switching device for controlling data writing to the pixel electrode 114, for example, an n-channel TFT (Thin Film Transistor). The transistor 141 includes a gate, a source and a drain, connected to the scanning line 115, the data line 116 and the pixel electrode 114, respectively. When a scanning signal at L (Low) level (non-selection signal) is inputted in the gate, the source and the drain of the transistor 61 are insulated from each other. When a scanning signal at H (High) level (selection signal) is inputted in the gate, the source and the drain of the transistor 141 become conductive to each other, and a data voltage is written to the pixel electrode 114. Also, the drain of the transistor 141 connects to the capacitance 142. The capacitance 142 retains a charge according to the data voltage. The pixel electrode 114 is provided at each of the pixels 14, and disposed opposite the common electrode 131. The common electrode 131 is commonly shared by the entire pixels 14, and is given a potential EPcom. The electrophoretic layer 12 is held between the pixel electrode 114 and the common electrode 131. The pixel electrode 114, the electrophoretic layer 12 and the common electrode 131 form the electrophoretic element 143. A voltage corresponding to a potential difference between the pixel electrode 114 and the common electrode 131 is applied to the electrophoretic layer 12. In the microcapsules 121, the electrophoretic particles move according to a voltage applied to the electrophoretic layer 12, thereby expressing a gray level. When the potential on the pixel electrodes 114 is positive (for example, +15V) with respect to the potential EPcom on the common electrode 131, the negatively charged white electrophoretic particles move toward the pixel electrode 114, and the positively charged black electrophoretic particles move toward the common electrode 131. As the display section 10 is viewed from the side of the second substrate 13, the pixels appear in black. When the potential on the pixel electrodes 114 is negative (for example, −15V) with respect to the potential EPcom on the common electrode 131, the positively charged black electrophoretic particles move toward the pixel electrodes 114, and the negatively charged white electrophoretic particles move toward the common electrode 131. In this instance, the pixels appear in white.

In the following description, a period starting from the selection of the scanning line in the $1^{st}$ row by the scanning line drive circuit 16 until the end of the selection of the scanning line in the $m^{-th}$ row is referred to as a "frame period" or, simply a "frame." Each of the scanning lines 115 is selected once in each frame, and a data signal is supplied to each of the pixels 14 once in each frame.

Figure 6:
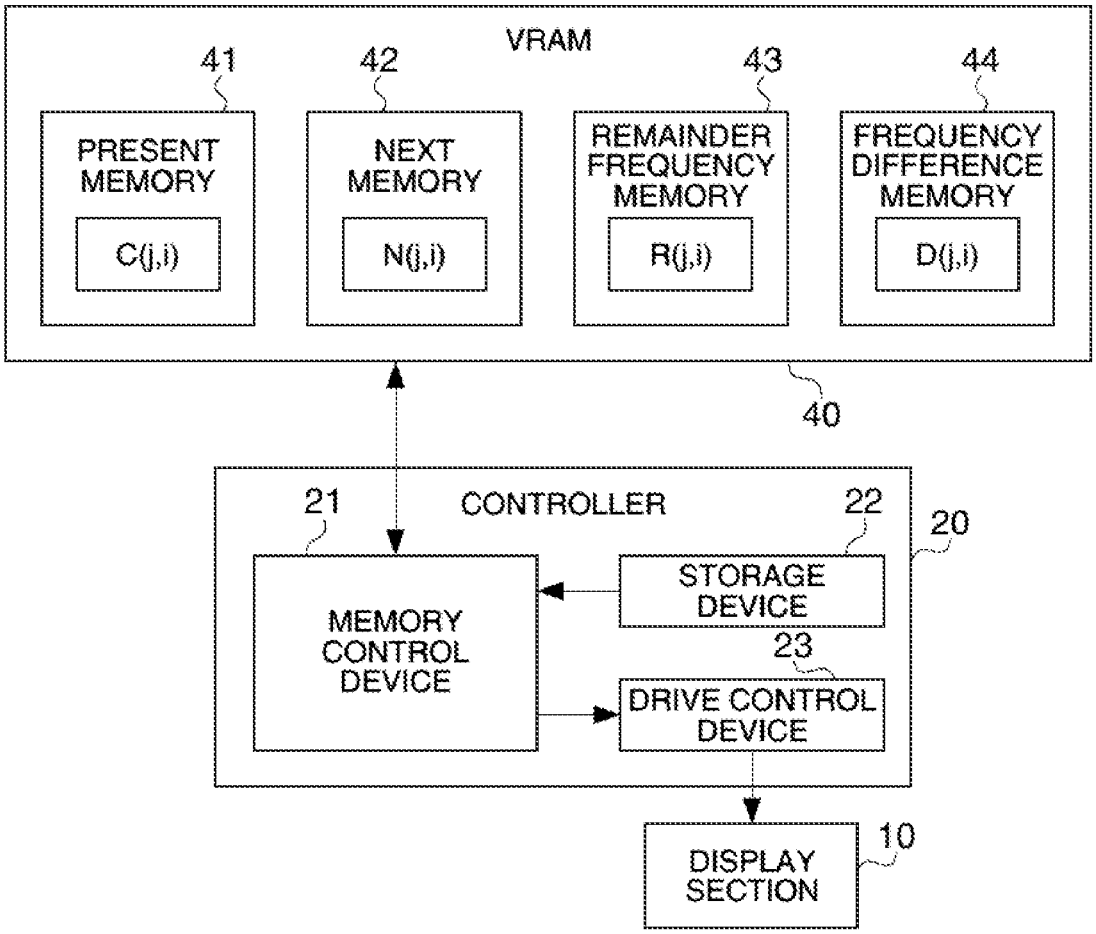
FIG. 6 is a diagram of a functional configuration of the electronic apparatus 1.

FIG. 6 is a block diagram showing the functional composition of the electronic apparatus 1 (in particular, the controller 20). The VRAM 40 has a present memory 41, a next memory 42, a remainder frequency memory 43, and a frequency difference memory 44. The present memory 41 (an example of the first memory) is a memory that stores a present gray level value C (j, i) for each of the multiple pixels 14. An image shown by data stored in the present memory 41 is called a "present image." The plural pixels 14 correspond to the plural electrophoretic elements 143 (one example of the electro-optic elements) whose gray level changes from a first gray level (for instance, white) into a second gray level (for instance, black) by voltage application multiple times in a predetermined period as the unit (for instance, a frame). The next memory 42 (one example of the second memory) is a memory that stores a gray level value N (j, i), for each of the plural pixels 14, to be displayed in the next period (frame) or later, that is, an image to which writing is scheduled next. An image expressed by the data stored in the next memory 42 is called a "next image." The remainder frequency memory 43 (one example of the third memory) is a memory that stores the remainder frequency R (j, i) of the voltage application for each of the plural pixels 14. The frequency difference memory 44 (one example of the fourth memory) is a memory that stores a frequency difference D (j, i), for each of the plural pixels 14. The frequency difference D (j, i) indicates a difference between the number of times of applications of a voltage of a negative polarity (one example of the first voltage) and the number of times of applications of a voltage of a positive polarity (one example of the second voltage) to the electrophoretic element 143 from a predetermined reference time (for instance, at the time when the power supply is turned on).

The controller 20 has a memory control device 21, a storage device 22, and a driving control device 23. The memory control device 21 controls the access (data write or read) to the VRAM 40. The memory control device 21 also updates the data stored in the VRAM 40 for each frame period. The storage device 22 stores various programs to update the data of the VRAM 40. The driving control device 23 has a line memory. The line memory stores data indicative of an application voltage for each group of pixels in each one target row among the plural pixels 14. The driving control device 23 performs a control to impress a voltage to target pixels based on the data stored in the line memory, when a gray level value C stored in the present memory 41 and a gray level value N stored in the next memory 42 are different from each other and a remainder frequency R stored in the remainder frequency memory 43 is not zero.

When a comparison result between the gray level value C stored in the present memory 41 and the gray level value N stored in the next memory 42 for the target pixel, and the remainder frequency R stored in the remainder frequency memory 43 meet a predetermined condition, the driving control device 23 rewrites the remainder frequency R with a set value decided according to the gray level value N stored in the next memory 42. The driving control device 23 executes a cleanup processing of displaying a predetermined image on plural pixels 14 with a predetermined timing. The cleanup processing includes an adjustment processing (a balance adjustment processing) of writing an adjustment image to the plural pixels 14 by voltage application to the plural pixels 14 until the frequency difference D meets a predetermined end condition.

2. Operation

The operation of the controller 20 is divided roughly into an image rewriting processing and a cleanup processing. The image rewriting processing is a processing to rewrite an image to be displayed. The cleanup processing is a processing to initialize the state of the electrophoretic particles, to prevent the gray level from blotting and burning. The cleanup processing includes a cleanup preprocessing, an adjustment processing, a predetermined image display processing, and a next image display processing. Hereafter, the outline and processing examples of these processing will be described.

2-1. Image Rewriting

2-1-1. Outline of Operation

Figure 7:
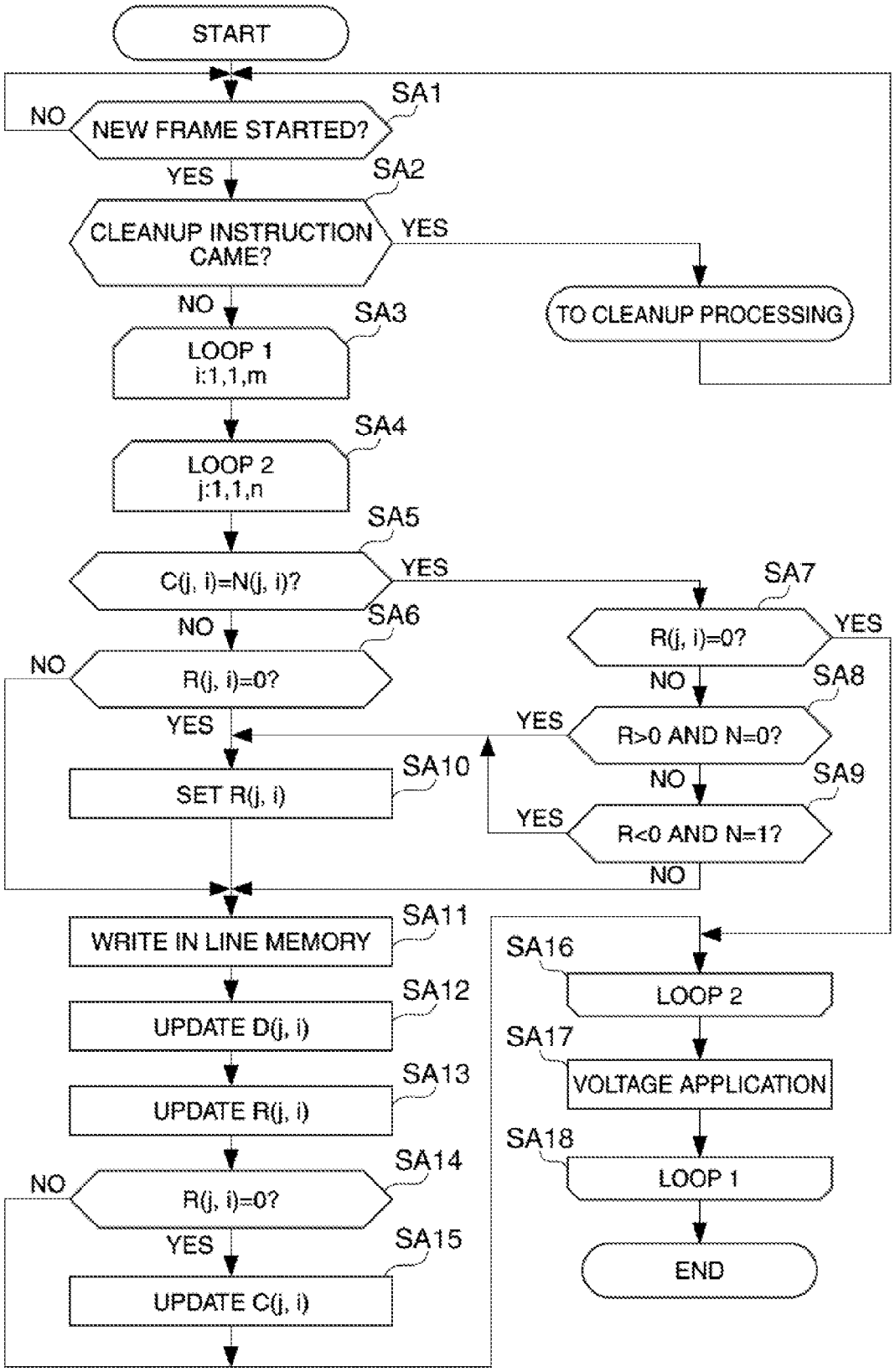
FIG. 7 is a flow chart showing an image rewriting processing.

FIG. 7 is a flow chart showing the image rewriting processing executed by the controller 20. The flow of FIG. 7 is started with an event that triggers an image rewriting as a trigger. Such an event may be, for example, an event in which an image rewriting instruction is input from the CPU 30. In the following examples, the gray level value C and the gray level value N are binary data, and take either a value "0" or a value "1." The gray level value "0" corresponds to white, and the gray level value "1" corresponds to black, respectively.

The controller 20 judges in step SA1 as to whether a new frame has begun. For instance, the beginning of a new frame is indicated by a synchronous signal output from a real time clock (not shown in the figure). The controller 20 shifts the processing to step SA2, when it is judged that a new frame has begun (step SA1: YES). When it is judged that a new frame has not begun (step SA1: NO), the controller 20 stands by until a new frame is begun.

The controller 20 judges, in step SA2, as to whether a cleanup instruction for starting the cleanup processing has been input. The cleanup processing is, for each of the plural pixels 14, a processing to initialize the state of the electrophoretic particles. For example, when the user performs an operation to turn the page forward or backward, the cleanup instruction is output to the controller 20 by CPU 30. When the cleanup instruction is input (step SA 2: YES), the controller 20 shifts the processing to the cleanup processing. When the cleanup instruction is not input (step SA2: NO), the controller 20 shifts the processing to step SA3.

The controller 20 initializes a loop counter i of a processing loop 1 in step SA3. The loop counter i is a parameter that specifies a line to be processed. The loop counter i is initialized, in this example, by i=1. The loop counter i is incremented by one on the loop edge. The processing loop 1 is repeated for m rows, that is, until i=m.

The controller 20 initializes a loop counter j of a processing loop 2 in step SA4. The loop counter j is a parameter that specifies a row to be processed. In other words, the target pixel is a pixel at the $i^{-th}$ row, the $j^{-th}$ column. The Loop counter j is initialized, in this example, by j=1. The loop counter j is incremented by one on the loop edge. The processing loop 2 is repeated for n columns, that is, until j=n.

In step SA5, the controller 20 judges, for the target pixel, as to whether the gray level value C (j, i) of the present pixel concurs with the gray level value N (j, i) of the next image. Concretely, the controller 20 reads the gray level value C (j, i) from the present memory 41 and the gray level value N (j, i) from the next memory 42, respectively, and judges as to whether these two gray level values concur with each other. The controller 20 shifts the processing to step SA7, when it is judged that these two gray level values concur with each other (step SA5: YES). When it is judged that these two gray levels of two judgments do not concur with each other (step SA5: NO), the controller 20 shifts the processing to step SA6.

In step SA6, the controller 20 judges as to whether the remainder frequency R (j, i) is "0." Concretely, the controller 20 reads the remainder frequency R (j, i) from the remainder frequency memory 43, and judges as to whether the read remainder number is "0." When the remainder frequency R (j, i) is "0" (step SA6: YES), the controller 20 shifts the processing to step SA10. When the remainder frequency R (j, i) is not "0" (step SA6: NO), the controller 20 shifts the processing to step SA11.

The controller 20 judges in step SA7 as to whether the remainder frequency R (j, i) is "0." When the remainder frequency R (j, i) is "0" (step SA7: YES), the controller 20 shifts the processing to step SA16. When the remainder frequency R (j, i) is not "0" (step SA7: NO), the controller 20 shifts the processing to step SA 8.

In step SA8, the controller 20 judges whether the remainder frequency R (j, i) and the gray level value N (j, i) meet the following conditions:

R>0 and

N=0

Concretely, the controller 20 reads the remainder frequency R (j, i) from the remainder frequency memory 43 and the gray level value N (j, i) from the next memory 42, respectively, and judges whether these conditions are met. When they are R>0 and N=0 (step SA8: YES), the controller 20 shifts the processing to step SA10. When they are R<0 or N≠0 (step SA8: NO), the controller 20 shifts the processing to step SA9.

In step SA9, the controller 20 judges whether the remainder frequency R (j, i) and the gray level value N (j, i) meet the following conditions:

R<0 and

N=1

When they are R<0 and N=1 (step SA9: YES), the controller 20 shifts the processing to step SA10. When they are R>0 or N≠1 (step SA9: NO), the controller 20 shifts the processing to step SA11.

The controller 20 newly sets a remainder frequency R (j, i) in step SA10. The remainder frequency R (j, i) is set according to the gray level value N (j, i). Concretely, when the gray level value N (j, i) is "1", the controller 20 writes "5" in the remainder frequency memory 43 as the remainder frequency R (j,i). When the gray level value N (j, i) is "0," the controller 20 writes "−5" in the remainder frequency memory 43 as the remainder frequency R (j, i). In this example, the sign of the remainder time R indicates the polarity of the impressed voltage. When the sign of the remainder frequency is positive, the voltage of a positive polarity (black voltage) is impressed. When the sign of the remainder frequency is negative, the voltage of a negative polarity (white voltage) is impressed. For instance, the remainder frequency "+5" indicates that the remainder number of voltage impressions for black writing is five times. In another example, the remainder frequency "−4" indicates that the remainder number of voltage impressions for white writing is four times. The remainder frequency R takes any one of the values between "−5" and "+5." The remainder frequency R being "0" indicates that there is no remainder number of the voltage applications. Here, in displaying the remainder frequency, the positive sign is omitted and, for example, only "5" is shown.

The controller 20 writes data corresponding to the remainder frequency R (j, i) in the line memory (not shown in the figure) in step SA11. The data written here indicates the polarity and the voltage value of the voltage impressed to the electrophoretic element 143. The data to be written in the line memory in this example is either "−1," "0" or "+1." For instance, when the remainder frequency R (j, i) is larger than "0" indicating that a black writing is to be performed, "+1" is written as data. When the remainder frequency R (j, i) is smaller than "0" indicating that white writing is to be performed, "−1" is written as data. When it is shown that the remainder frequency R (j, i) is "0" and neither black writing nor white writing is to be performed, "0" is written as data.

In step SA12, the controller 20 updates the frequency difference D (j, i). The frequency difference D is updated according to the polarity of the impressed voltage. Concretely, when "+1" is stored in the line memory, the controller 20 increments the frequency difference D (j, i). When "−1" is stored in the line memory, the controller 20 decreases the frequency difference D (j, i). When "0" is stored in the line memory, the controller 20 maintains the value of the frequency difference D (j, i).

The controller 20 updates the remainder frequency R (j, i) in step SA13. Concretely, the controller 20 decrements the absolute value of the remainder frequency R (j, i). When the remainder frequency R (j, i) is "0," the controller 20 maintains the value. The controller 20 updates the remainder frequency R (j, i) read from the remainder frequency memory 43, and writes the updated remainder frequency R (j, i) to the remainder frequency memory 43. In step SA14, the controller 20 judges whether the remainder frequency R (j, i) is "0." When the remainder frequency R (j, i) is "0" (step SA14: YES), the controller 20 shifts the processing to step SA15. When the remainder frequency R (j, i) is not "0" (step SA14: NO), the controller 20 shifts the processing to step SA16.

The controller 20 updates the gray level value C (j, i) in step SA15. Concretely, the controller 20 updates the gray level value C (j, i) to C (j, i)=N (j, i).

The controller 20 processes the loop edge of the processing loop 2 in step SA16. Concretely, the controller 20 judges whether the loop counter j is j=n. When it is not j=n, the controller 20 increments the loop counter j and shifts the processing to step SA4. When it is j=n, the controller 20 shifts the processing to step SA17.

The controller 20 outputs a signal to drive the display part 10 in step SA17. The controller 20 reads out data from the line memory, and outputs the read data to the data line drive circuit 17 with a timing synchronized with the scanning of the scanning lines 115. Moreover, when the first row is a target row to be processed, the controller 20 outputs a signal for starting the scanning of the scanning lines 115, to the scanning line drive circuit 16. When the second or higher row is a target row to be processed, the controller 20 outputs a signal indicative of the scanning timing, to the scanning line drive circuit 16. In the display part 10, data is written in the pixel 14 at the $i^{-th}$ row by these signals.

The controller 20 processes the loop edge of the processing loop 1 in step SA18. Concretely, the controller 20 judges whether the loop counter is i=m. The controller 20 increments the loop counter i when it is not i=m, and shifts the processing to step SA3. When it is i=m, the controller 20 ends the processing.

2-1-2. Operation Example

FIG. 8 shows tables showing changes in data stored in each storage area with the lapse of time. In FIG. 8, fore four pixels (pixels 1 through 4) among the plural pixels 14 of the display part 10, the gray level value C of the present memory 41, the gray level value N of the next memory 42, the value of the remainder frequency R of the remainder frequency memory 43, and the frequency difference D of the frequency difference memory 44 are shown.

In this example, the number of voltage applications that requires to rewrite the display from pixels displayed in white (hereafter, referred to as "white pixels") to pixels displayed in black (hereafter, referred to as "black pixels") (hereafter, this rewriting is referred to as "black writing") is different from the number of voltage applications that requires to rewrite the display from pixels displayed in black to pixels displayed in white (hereafter, referred to as "white writing"). The pixels 14 change from the white display into the black display by impressing a black voltage (for instance, +15V) three times (one example of 3 frames, the a times), and change from the black display into the white display by impressing a white voltage (for instance, −15V) five times (one example of 5 frames, the b times). However, in this example, in both cases of beginning the black writing and beginning the white writing, the absolute value of the remainder frequency is set to one with a greater number of voltage applications, that is, five times.

The frequency difference D indicates a frequency difference between the number of voltage applications for black writing and the number of voltage impressions for white writing. For instance, the frequency difference "+5" indicates that the frequency of voltage applications for black writing is five times more than the frequency of voltage applications for white writing. The frequency difference "−3" indicates that the frequency of voltage applications for white writing is 3 times more than the frequency of voltage applications for black writing. The frequency difference "0" indicates that the frequencies of voltage applications for black writing and white writing are equal. Here, in displaying the frequency difference, the positive sign is omitted and only "5" is shown.

FIG. 8 further shows impressed voltages V and optical states H of the pixels 14. The sign "+" is shown in each frame to which the voltage of a positive polarity is impressed, and the sign "−" is shown in each frame to which the voltage of a negative polarity is impressed, respectively. "0" is shown in each frame to which the voltage is not impressed (frame to which no voltage is impressed.)

The optical state of the pixel 14 is expressed expediently by using one of integers from "0" to "5" in this example. The integer "0" indicates a white display state (for instance, the state in which the relative reflectivity is 90% or more), and the integer "5" indicates a black display state (for instance, the state in which the relative reflectivity is 10% or less). The values other than "0" and "5," that is, the values from "1" to "4" expediently indicate transition states in which the display changes to the white display or to the black display. For instance, when black writing is performed three times from the white display state "0," the optical state of the pixel 14 changes to "1," "4," to "5" and assumes the black display state. For instance, when white writing is performed five times from the black display state "5," the optical state of the pixel 14 changes to "4," "3," "2," "1," to "0" and assumes the white display state. In the initial state, the optical state of the pixel 14 is "0," that is, the white display and, at this point, the frequency difference D is set to "0." Note that, in the initial state, the gray level value C, the gray level value N, and the value of the remainder frequency R are also "0," respectively.

In FIG. 8, each data is shown in a manner divided for each frame. In FIG. 8, the data of each of the storage areas from the initial state (the 0th frame) to the 25th frame is shown. The leftmost row shows the initial state and the rightmost row shows the state of the 25th frame. For the pixel 1 to the pixel 4, the values of the gray level value C, the gray level value N, the remainder frequency R, and the frequency difference D are expressed as C1-C4, N1-N 4, R1-R4, and D1-D4, respectively. The optical state H and the application voltage V are similarly expressed. In FIG. 8, the gray level value C and the gray level value N of the $k^{-th}$ frame show values at the initial state of the $k^{-th}$ frame, for instance, the values of the $k^{-th}$ frame in step SA5. The frequency difference D of the $k^{-th}$ frame shows a value after the $k^{-th}$ frame ends, for instance, a value after step SA18. The remainder frequency R of the $k^{-th}$ frame is a value immediately before it is updated in step SA13 for the $k^{-th}$ frame. The absolute value of the remainder number R when the $k^{-th}$ frame ends, because it is updated in step SA13 of the $k^{-th}$ frame, becomes a value that is decreased by one from the value shown in the figure. The optical state of the pixel 14 of the $k^{-th}$ frame is a value after the $k^{-th}$ frame ends, for instance, after step SA18 of the $k^{-th}$ frame. The impressed voltage of the $k^{-th}$ frame indicates the voltage impressed in step SA17 of the $k^{-th}$ frame.

In the first frame, C=N (step SA 5: YES), and R=0 (step SA7: YES) for all of the pixels 1-4. At this time, because "0" is written in the line memory, the voltage is not impressed (step SA17). When the processing for the first frame ends, the optical state of the pixels 1-4 is the same as the initial state. In this example, the data of the next memory 42 is rewritten at a certain moment in the first frame.

In the second frame, for the pixel 1, C1≠N1 (step SA5: NO), and R1=0 (step SA6: YES). At this time, R1=5 is set, because N1=1 (step SA10). "+1" is written in V1 because R1>0 (step SA11). D1 is incremented and updated to D1=1 because V1=+1 (step SA12). Next, the absolute value of R1 is decremented and updated to R1=4 (step SA13). After the update, C1 is not updated because R1≠0 (step SA14: NO). For the pixel 2 and the pixel 3, processing similar to the processing of the pixel 1 is performed. For the pixel 4, as the data of the next memory 42 has not been updated, processing similar to the processing of the first frame is performed. A black voltage is impressed to the pixels 1-3 (step SA17). The voltage impression is not performed for the pixel 4. As for pixels 1-3, when the processing of the second frame ends, H1-H3 are "1," respectively. As for the pixel 4, H4 is "0."

In the third frame, for the pixel 1, C1≠N1 (step SA5: NO), and R1≠0 (step SA6: NO). "+1" is written in V1 because R1>0 (step SA11). Because V1=+1 (step SA12), D1 is incremented and updated to D1=2. The absolute value of R1 is decremented and updated to R1=3 (step SA13). After the update, C1 is not updated because R1≠0 (step SA14: NO). For the pixel 2 and the pixel 3, a processing similar to the processing of the pixel 1 is performed. For the pixel 4, a processing similar to the processing of the first frame is performed. As for the pixels 1-3, when the processing of the third frame ends, H1-H3 are "4." As for the pixel 4, H4 is "0." Because the initial state is maintained for the pixel 4 through repeating the similar processing even after the fourth frame, the content of each of the storage areas for the pixels 1-3 will be described.

In the fourth frame, for the pixel 1, C1=N1 (step SA5: YES), and R1≠0 (step SA7: NO). Also, R1>0 and N1=0 (step SA8: YES). At this moment, because N1=0, R1=−5 is set (step SA10). "−1" is written in V1 because R1<0 (step SA11). D1 is incremented and updated to D1=1 because V1=−1 (step SA11). Next, the absolute value of R1 is decremented and updated to R1=−4 (step SA13). After the update, C1 is not updated because R1≠0 (step SA14: NO). For the pixel 2 and the pixel 3, a processing similar to the processing of the pixels 1-3 in the third frame is performed. As for the pixel 1, when the processing of the fourth frame ends, H1 is "3." As for the pixels 2 and 3, H2 and H3 are "5."

In the fifth frame, for the pixel 1, C1=N1 (step SA5: YES), and R1≠0 (step SA7: NO). Also, R1<0 (step SA8: NO) and N1≠1 (step SA9: NO). Because R1<0, "−1" is written in V1 (step SA11). Because V1=−1, D1 is incremented and updated to D1=0 (step SA12). Next, the absolute value of R1 is decremented and updated to R1=−3 (step SA13). After the update, C1 is not updated because R1≠0 (step SA14: NO). For the pixel 2 and the pixel 3, a processing similar to the processing of the pixels 2 and 3 in the fourth frame is performed. As for the pixel 1, when the processing of the fifth frame ends, H1 is "2." As for the pixels 2 and 3, as H2 and H3 are at the maximum value "5," the value is maintained.

In the sixth frame, for the pixel 1, a processing similar to the processing of the pixel 1 in the fifth frame is performed. For the pixel 2, a processing similar to the processing of the pixel 2 in the fifth frame is performed. The absolute value of R2 is decremented and updated to R2=0 (step SA13). After the update, C2 is updated (step SA15) because R2=0 (step SA14: YES). Here, because N2=1, it is updated to C2=1. For the pixel 3, a processing similar to that of the pixel 2 is performed. As for the pixel 1, when the processing of the sixth frame ends, H1 is "1." As for the pixels 2 and 3, H2 and H3 are at the maximum value "5." For the $7^{th}$ frame to the $20^{th}$ frame, operations for a portion of the frames will be described.

In the eighth frame, for the pixel 1, C1=N1 (step SA5: YES), and R1≠0 (step SA7: NO). Also, R1<0 (step SA8: NO) and N1≠1 (step SA9: NO). Because R1<0, "−1" is written in V1 (step SA11). Because V1=−1, D1 is decremented and updated to D1=−3 (step SA12). Next, the absolute value of R1 is decremented and updated to R1=0 (step SA13). After the update, C2 is updated (step SA15), because R1=0 (step SA14: YES). Here, because N1=0, C2 is updated to 0 (C2=0). Note that, at the start of the $8^{th}$ frame, because C2=0, the value of C2 is maintained even after the update. For the pixel 2, C1≠N2 (step SA5: NO), and R2=0 (step SA6: YES). At this moment, because N2=0, R2 is set to −5 (R2=−5) (step SA10). Also, because R2<0, "−1" is written in V2 (step SA11). Because V2=−1, D2 is incremented and updated to D2=4 (step SA12). Next, the absolute value of R2 is decremented and updated to R2=−3 (step SA13). After the update, C2 is not updated, because R2≠0 (step SA14: NO).

In the $10^{th}$ frame, for the pixel 2, C2=N2 (step SA5: YES), and R2≠0 (step SA7: NO). Also, R2<0 (step SA8: NO), and N2=1 (step SA9: YES). At this moment, N2=1, R2=5 is set (step SA10). Because R2>0, "+1" is written in V2 (step SA11). Because V2=+1, D2 is incremented and updated to D2=4 (step SA12). The absolute value of R2 is decremented and updated to R2=4 (step SA13). After the update, C2 is not updated, because R2≠0 (step SA14: NO). When the processing of the $20^{th}$ frame ends, H1=3, H2=5, H3=5 and H4=0 are attained.

2-2. Cleanup

2-2-1. Cleanup Preprocessing

Figure 9:
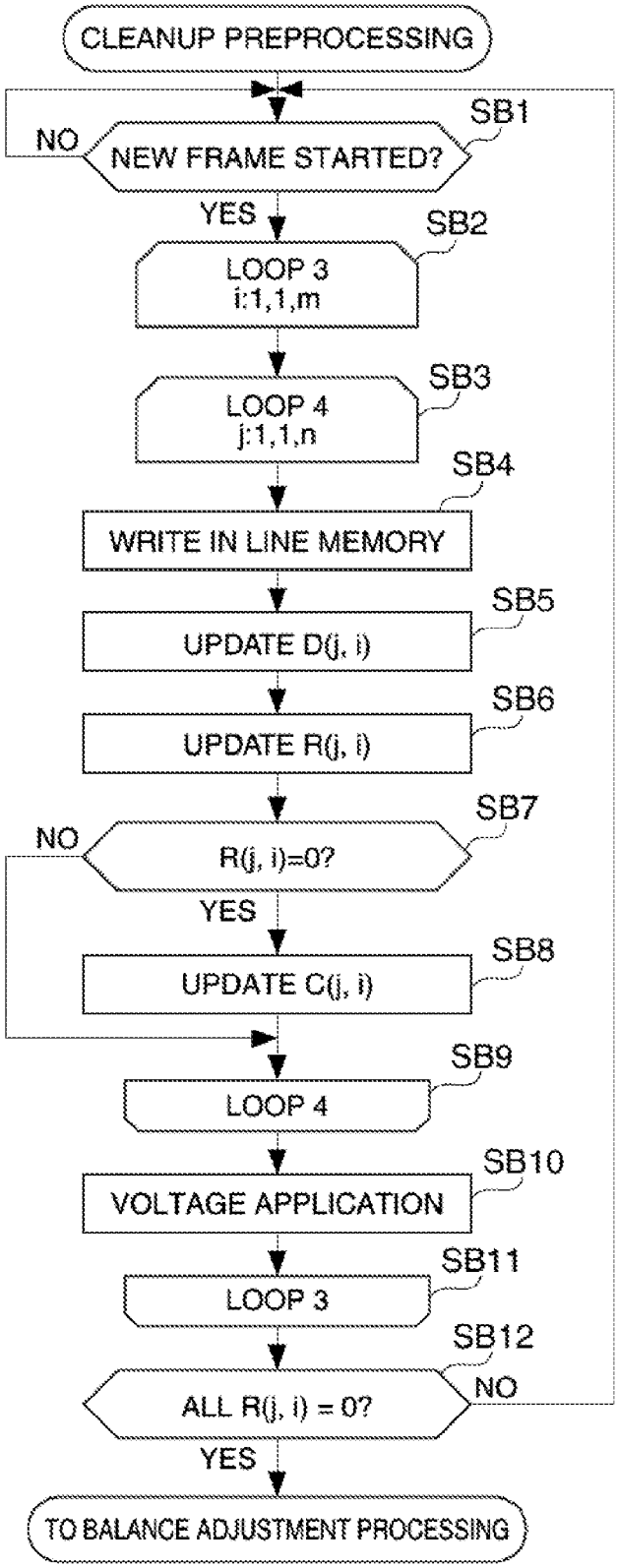
FIG. 9 is a flow chart showing a cleanup pre-processing.

FIG. 9 is a flow chart showing the cleanup preprocessing executed by the controller 20. In step SB1, the controller 20 judges whether a new frame has begun. When it is judged that a new frame has begun (step SB1: YES), the controller 20 shifts the processing to step SB2. When it is judged that a new frame has not begun (step SB1: NO), the controller 20 stands by until a new frame is begun.

In step SB2, the controller 20 initializes the loop counter i of the processing loop 3. In this example, the loop counter i is initialized to i=1. The loop counter i is incremented by one at the loop edge. The processing loop 3 is repeated for m rows, that is, up to i=m. The controller 20 initializes the loop counter j of the processing loop 4 in step SB3. In this example, the loop counter j is initialized to j=1. The loop counter j is incremented by one at the loop edge. The processing loop 4 is repeated for n rows, that is, up to j=n.

In step SB4, the controller 20 writes data corresponding to the remainder frequency R (j, i) in the line memory (not shown in the figure). Writing in the line memory is performed similarly to the processing in step SA11. The controller 20 updates the frequency difference D (j, i) in step SB5. The frequency difference is updated similarly to the processing in step SA12. The controller 20 updates the remainder frequency R (j, i) in step SB6. The remainder frequency R is updated in a manner similar to the processing in step SA13.

In step SB7, the controller 20 judges whether the remainder frequency R (j, i) is "0." When the remainder frequency R (j, i) is "0" (step SB7: YES), the controller 20 shifts the processing to step SB8. When remainder frequency R (j, i) is not "0" (step SB7: NO), the controller 20 shifts the processing to step SB9.

In step SB8, the controller 20 updates the gray level value C (j, i). Concretely, the controller 20 updates the gray level value C (j, i) to "1" for the pixel to which black writing was performed and the gray level value C (j, i) to "0" for the pixel to which white writing was performed. In step SB9, the controller 20 processes the loop edge of the processing loop 4. Concretely, the controller 20 judges whether the loop counter j is j=n. When it is not j=n, the controller 20 increments the loop counter j and shifts the processing to step SB3. When j=n, the controller 20 shifts processing to step SB10.

In step SB10, the controller 20 outputs a signal to drive the display part 10. In the display part 10, data is written to the pixel 14 in the $i^{-th}$ row by this signal. In step SB11, the controller 20 processes the loop edge of the processing loop 3. Concretely, the controller 20 judges whether the loop counter i is i=m. When it is not i=m, the controller 20 increments the loop counter i and shifts the processing to step SB2. The controller 20 ends the processing in the case of i=m.

In step SB12, the controller 20 judges whether the remainder frequency R is "0" for all the pixels. Concretely, the controller 20 judges whether the sum total of the absolute values of the remainder frequencies R is "0." When the remainder frequency R is "0" for all the pixels (step SB12: YES), the controller 20 shifts the processing to the adjustment processing. When the remainder frequency R is not "0" of all the pixels (step SB12: NO), the controller 20 shifts the processing to step SB1.

FIG. 8 is referred to again. In the example of FIG. 8, the cleanup preprocessing is performed between the $21^{st}$ frame and the $25^{th}$ frame. In the $21^{st}$ frame, "−1" is written in V1 for the pixel 1 because R1<0, and "+1" is written in V2 for the pixel 2 because R2>0 (step SB4). "0" is written in V3 and V4 for the pixel 3 and the pixel 4 because R3=R4=0 (step SB4). D1 is decremented and updated to D1=−6, and D2 is incremented and updated to D2=10 (step SB5). The absolute values of R1 and R2 are decremented and updated to R1=−3 and R 2=1 (step SB6), respectively. After the update, neither C1 nor C2 are updated because R1≠0, and R2≠0 (step SB7: NO). A white voltage is impressed to the pixel 1, and a black voltage is impressed to the pixel 2 (step SB10). These processing is repeated until R=0 is attained for all the pixels in the 24th frame (until the condition in step SB12 is met). When the processing of the 24th frame ends, H1=0, H2=5, H3=5, and H4=0 are attained.

2-2-2. Adjustment Processing

Figure 10:
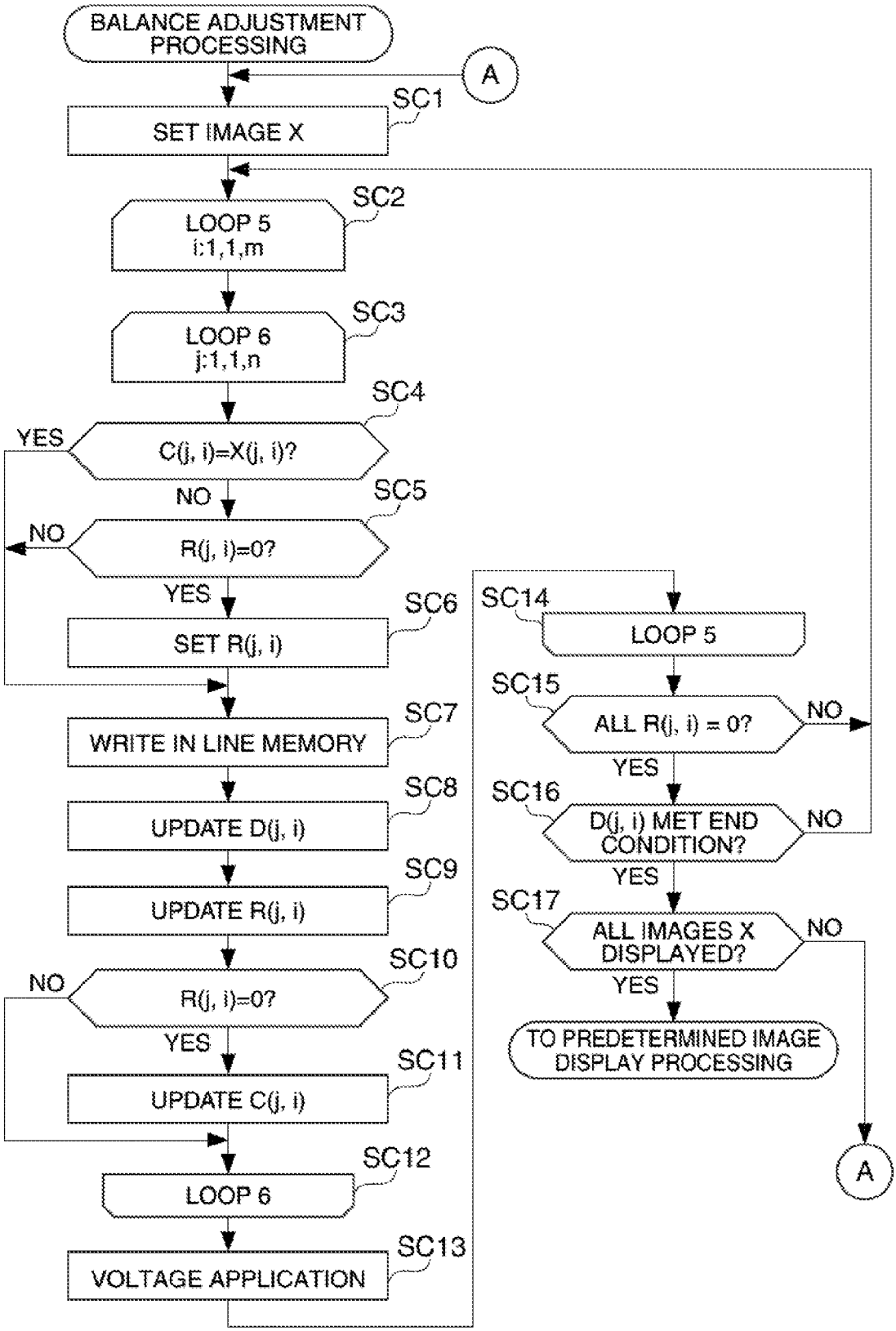
FIG. 10 is a flow chart showing an adjustment processing.

FIG. 10 is a flow chart showing the adjustment processing executed by the controller 20. The adjustment processing is a processing for adjusting the frequency difference D to meet a predetermined condition.

In step SC1, the controller 20 sets an adjustment image. The adjustment image is an image for adjusting such that the frequency difference D meets a predetermined condition. Hereafter, the adjustment image is expressed as an "image X." The image X may include plural images. When plural images are included in the image X, subscripts are used, like, "image XA," "image XB," etc., to distinguish these images. In step SC1, one image X selected from among plural images X is set as an image used for the following processing. For instance, the one image X may be selected according to the value of the counter. One is added in step SC1, whereby the value of the counter is updated. As for the value of the counter, "1" is set as an initial value. The controller 20 reads one image corresponding to the value of the counter among the plural images from the memory device 22.

In step SC2, the controller 20 initializes the loop counter i of the processing loop 5. The loop counter i is initialized in this example to i=1. The loop counter i is incremented by one on the loop edge. The processing loop 5 is repeated for m rows, that is, up to i=m. The controller 20 initializes the loop counter j of the processing loop 6 in step SC3. The loop counter j is initialized in this example to j=1. The loop counter j is incremented by one at the loop edge. The processing loop 6 is repeated for n columns, that is, up to j=n.

In step SC4, the controller 20 judges, for the target pixel, whether the gray level value C (j, i) of a present frame concurs with the gray level value X (j, i) of the image X. Concretely, the controller 20 reads the gray level value C (j, i) from the present memory 41 and the gray level value X (j, i) from the memory device 22, respectively, and judges whether these two gray level values concur with each other. When it is judged that these two gray level values concur with each other (step SC4: YES), the controller 20 shifts the processing to step SC7. When it is judged that these two gray level values do not concur with each other (step SC4: NO), the controller 20 shifts the processing to step SC5.

In step SC5, the controller 20 judges whether the remainder frequency R (j, i) is "0." When remainder frequency R (j, i) is "0" (step SC5: YES), the controller 20 shifts the processing to step SC6. When the remainder frequency R (j, i) is not "0" (step SC6: NO), the controller 20 shifts the processing to step SC7.

In step SC6, the controller 20 newly sets the remainder frequency R (j, i). When the gray level value X (j, i) is "1," the controller 20 writes "5" in the remainder frequency memory 43 as the remainder frequency R (j, i). When the gray level value X (j, i) is "0," the controller 20 writes "−5" in the remainder frequency memory 43 as the remainder frequency R (j, i).

In step SC7, the controller 20 writes data corresponding to the remainder frequency R (j, i) in the line memory. The relation between the data written in the line memory and the remainder frequency R (j, i) has been decided according to the image X. The controller 20 updates the frequency difference D (j, i) in step SC8. The update of the frequency difference D (j, i) is done similarly to step SA12. In step SC9, the controller 20 updates the remainder frequency R (j, i). The update of the remainder frequency R (j, i) is done similarly to step SA13. The controller 20 judges in step SC10 whether the remainder frequency R (j, i) is "0." When the remainder frequency R (j, i) is "0" (step SC10: YES), the controller 20 shifts the processing to step SC11. When the remainder frequency R (j, i) is not "0" (step SC10: NO), the controller 20 shifts the processing to step SC12.

In step SC11, the controller 20 updates the gray level value C (j, i). Concretely, the controller 20 updates the gray level value C (j, i) to C (j, i)=X (j, i).

In step SC12, the Controller 20 processes the loop edge of the processing loop 6. Concretely, the controller 20 judges whether the loop counter j is j=n. When it is not j=n, the controller 20 increments the loop counter j, and shifts the processing to step SC3. When j=n, the controller 20 shifts the processing to step SC13.

In step SC13, the controller 20 outputs a signal to drive the display part 10. As a result, data is written to the pixel 14 in the $i^{-th}$ row in the display part 10. In step SC14, the controller 20 processes the loop edge of the processing loop 5. Concretely, the controller 20 judges whether the loop counter i is i=m. When it is not i=m, the controller 20 increments the loop counter i and shifts the processing to step SC2. When i=m, the controller 20 shifts the processing to step SC15.

In step SC15, the controller 20 judges whether the remainder frequency R is "0" for all the pixels. When the sum total is "0" of the remainder frequencies (step SC15: YES), the controller 20 shifts the processing to step SC16. When the sum total of the remainder frequencies is not "0" (step SC15: NO), the controller 20 shifts the processing to step SC2.

In step SC16, the controller 20 judges whether the frequency difference D (j, i) has met an end condition. The end condition has been decided according to the image X. When the frequency difference D (j, i) meets the end condition (step SC16: YES), the controller 20 shifts the processing to step SC17. When the frequency difference D (j, i) does not meet the end condition (step SC16: NO), the controller 20 shifts the processing to step SC2.

In step SC17, the controller 20 judges whether writing for the entire images X has been completed. Concretely, when the value of the counter is the same as the number of the plural images included in the image X, the controller 20 judges that writing for the entire images X is completed. When the value of the counter is less than the number of the plural images X included in the adjustment image, the controller 20 judges that writing for the entire images X has not been completed. When the controller 20 judges that writing for the entire images X is completed (step SC17: YES), the controller 20 shifts the processing to the predetermined image display processing. When it is judged that writing for the entire images X has not been completed (step SC17: NO), the controller 20 adds one to the value of the counter, and shifts the processing to step SC1. In this case, the controller 20 sets an image X corresponding to the value of the counter after it has been updated, again in step SC1.

2-2-3. Predetermined Image Display Processing

Figure 11:
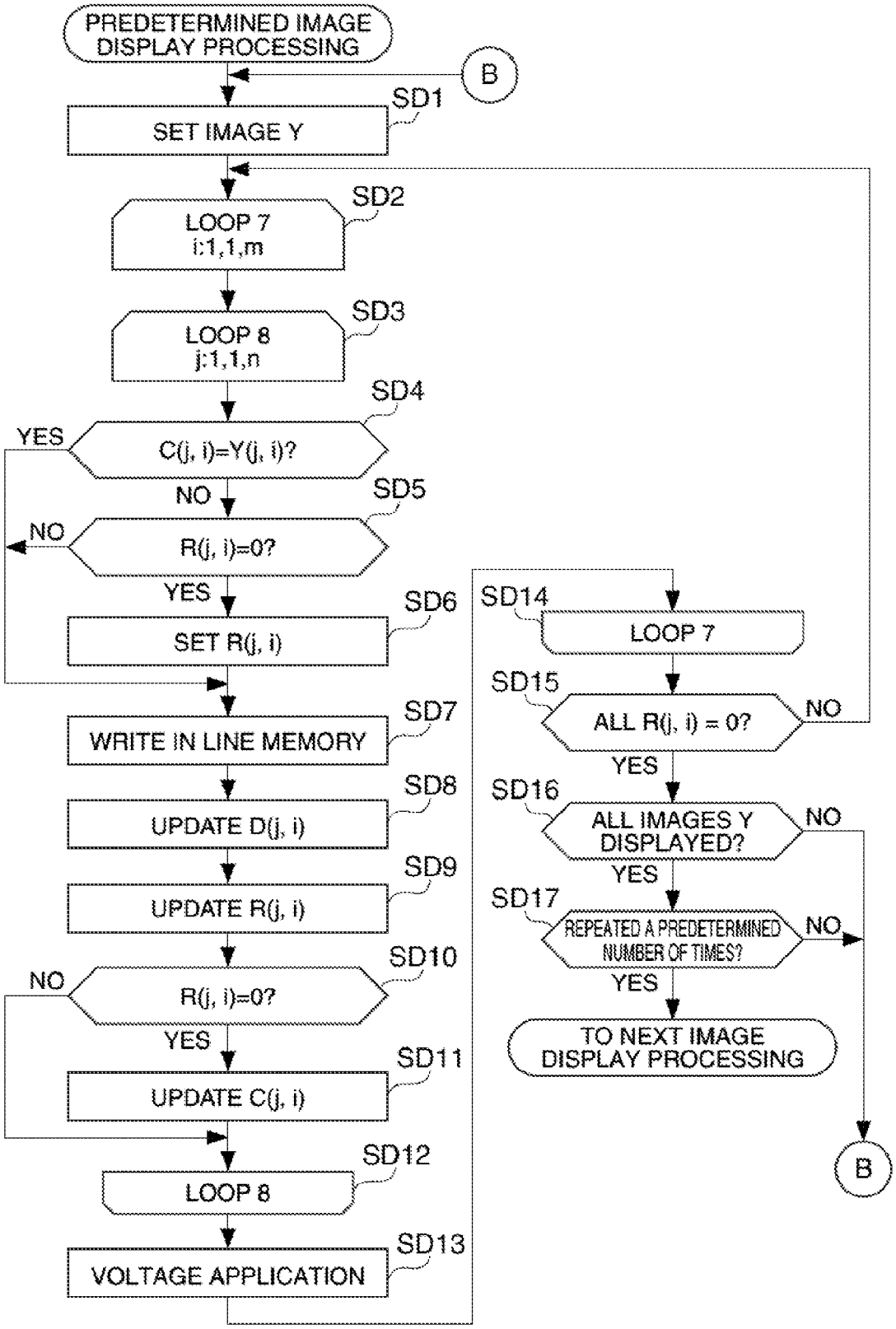
FIG. 11 is a flow chart showing an operation of a predetermined image display processing.

FIG. 11 is a flow chart showing the operation of the controller 20 in the predetermined image display processing. The predetermined image display processing is a processing to initialize the state of the electrophoretic particles, for each of the plural pixels 14. In step SD1, the controller 20 sets a predetermined image. Hereafter, the predetermined image is expressed as an "image Y." The image Y includes plural images. The plural images included in the image Y are distinguished one from the other by using subscripts, like, "image YA," "image YB," etc. In step SD1, one image Y selected from among plural images Y is set as an image used for the following processing. For instance, the one image Y may be selected according to the value of the counter. One is added in step SD1, whereby the value of the counter is updated. As for the value of the counter, "1" is set as an initial value. The controller 20 reads the one image corresponding to the value of the counter among the plural images from the memory device 22.

From step SD2 to step SD14, the processing performed from step SC2 to step SC14 is similarly performed. In step SD15, the controller 20 judges whether the remainder frequency R is "0" for all the pixels. Whether the remainder frequency R is "0" for all the pixels may be judged, for instance, according to whether the sum total of the absolute values of the remainder frequencies R is "0." The controller 20 shifts the processing to step SD16 when it is judged that the remainder frequency R is "0" for all the pixels (step SD15: YES). When the sum total of the remainder frequencies is not "0" (step SD15: NO), the controller 20 shifts the processing to step SD2.

In step SD16, the controller 20 judges whether writing for all the images Y has completed. Concretely, the controller 20 judges that writing for all the images Y has completed, when the value of the counter is the same as the number of the plural images included in the image Y. The controller 20 judges that writing for all the images Y has not been completed when the value of the counter is less than the number of plural images Y included in the predetermined image. The controller 20 shifts the processing to step SD17, when it is judged that writing for all the images Y has been completed (step SD16: YES). When it is judged that writing for all the images Y has not yet completed (step SD16: NO), the controller 20 adds one to the value of the counter, and shifts the processing to step SD1. In this case, the controller 20 sets an image Y corresponding to the value of the counter after the update, again in step SD1.

In step SD17, the controller 20 judges whether display of the image Y has been repeated a predetermined number of times. The controller 20 adds one to the value of a repetition number counter in step SD1. As for the value of the repetition number counter, "1" is set as an initial value. The controller 20 shifts the processing to the next image display processing, when the number of repetition is more than the predetermined number of times (step SD17: YES). When the number of repetition is smaller than the predetermined number of times (step SD17: NO), the controller 20 shifts the processing to step SD1, and adds one to the value of the repetition number counter. In this case, the controller 20 sets an image Y corresponding to the initial value "1" of the counter again.

2-3. Processing Examples

Hereunder, some specific processing examples of the cleanup processing will be described. The adjustment image (image X), the writing condition and the end condition are different in each of the processing examples, respectively.

2-3-1. Processing Example 1

FIG. 12 shows an example of changes of data with the passage of time stored in each of the storage areas in accordance with a processing example 1. The frame numbers in FIG. 12 are expressed by serial numbers from the frames shown in FIG. 8. In the processing example 1, various conditions are set as follows:

(1) Image X

Image XA (one example of the first image) and Image XB (one example of the second image) are included.

Image XA (all-black image): For all the pixels, X=1 (one example of the first gray level); and Image XB (all-white image): For all the pixels, X=0 (one example of the second gray level)

(2) Data Writing Condition in Step SC7

Commonly applied to both Image XA and Image XB

When R>0: Black writing

When R<0: White writing

In Case of Image XA

When R=0 and D<5: Black writing

In Case of Image XB

When R=0 and D>0: White writing

Writing is not carried out in cases other than the above.

(3) End Condition

In case of Image XA: Dmin≥5 (one example of the first reference value)

(Dmin is the minimum value in the frequency differences D of all pixels)

In case of Image XB: D=0 (one example of the second reference value) for all pixels (Or, Dmax≤0).

(Dmax is the maximum value in the frequency differences D of all pixels.

As described above, the pixel 14 changes from a white display into a black display by voltage impression three times (one example of a times), and changes from a black display into a white display by voltage impression five times (one example of b times). In this example, the difference between the first reference value ("5" in this example) and the second reference value ("0" in this example) is equal to the value of a larger one of the a times and the b times, that is "5." Further, in the following description, the gray level value X and the gray level value Y for each of the pixels 1-4 are expressed as X1-X4 and Y1-Y4, respectively.

In the 26$^{th}$ frame, first, the image XA is set (step SC1). For the pixel 1 and the pixel 4, the gray level value C and the gray level value X are different (step SC4: NO), and the remainder frequency R is 0 (step SC5: YES), such that the remainder frequency is set to "5" (step SC6). The remainder frequency for other pixels is not changed. Black writing is performed for the pixel 1 and the pixel 4 (step SC7). In response to the black writing, the frequency difference D of the pixel 1 is updated from "−9" to "−8," and the frequency difference D of the pixel 4 is updated from "0" to "1," respectively (step SC8). In addition, in response to the black writing, the remainder frequency R of the pixel 1 and the pixel 4 is decremented from "5" to "4" (step SC9). These processing is repeated until R becomes R=0 for all the pixels in the 30th frame (until the condition in step SC15 is met).

The frequency difference D of the pixel 1 is "−4" at the time of the end of the 30$^{th}$ frame, and the end condition has not yet been met (step SC16: NO). Therefore, black writing for the pixel 1 is repeated until the frequency difference D of the pixel 1 becomes "5" and the end condition is met in the 39th frame.

In step SC8 in the 39$^{th}$ frame, the frequency difference D of the pixel 1 is updated to "5," and the end condition is met (step SC16: YES). At this point, the optical state of all the pixels is in the black display state.

In the 40$^{th}$ frame, the image XB is set (step SC1). Because, for all the pixels, the gray level value C and the gray level value X are different (step SC4: NO), and the remainder frequency R is 0 (step SC5: YES), the remainder frequency is set to "−5" (step SC6). White writing is performed for all the pixels (step SC7). In response to the white writing, the frequency difference D of the pixel 1 is updated from "5" to "4", and the frequency difference D of the pixel 2 is updated from "11" to "10," respectively (step SC8). In addition, in response to the white writing, the remainder frequency R for all the pixels is incremented from "−5" to "−4" (the absolute value of the remainder frequency R is decremented) (step SC9). These processings are repeated until R becomes R=0 for all the pixels in the 44$^{th}$ frame (until the condition in step SC15 is met).

At the time of the end of the 44$^{th}$ frame, the frequency difference D of the pixel 2 is "6," and the end condition has not yet been met (step SC16: NO). Therefore, white writing for the pixel 2 is repeated until the frequency difference D of the pixel 2 becomes "0" and the end condition is met in the 50th frame.

In step SC8 of the 50$^{th}$ frame, the frequency difference D of the pixel 2 is updated to "0", and the end requirement is met (step SC16: YES). At this point, the optical state of all the pixels is in the white display state. Moreover, the frequency difference D became "0" for all the pixels by writing the image XA and the image XB, and the impressed voltages assume a polarity-balanced state. As a result, deterioration of the electrophoretic elements 143 can be suppressed compared with the case where the cleanup processing is performed with the polarity balance being biased.

A cleanup processing (a predetermined image display processing and a next image display processing) similar to the previous cleanup processing is performed for the 51$^{st}$ frame and thereafter. In the predetermined image display processing, various conditions are set as follows:

(1) Image Y

Image YA and Image YB are included.

Image YA (all-black image): For all the pixels, Y=1 (one example of the first gray level); and Image YB (all-white image): For all the pixels, Y=0 (one example of the second gray level)

(2) Data Writing Condition in Step SD7

Commonly applied to both Image YA and Image YB

When R>0: Black writing

When R<0: White writing 2-3-2. Processing Example 2

FIG. 13 shows an example of changes of data with the passage of time stored in each of the storage areas in accordance with a processing example 2. The frame numbers in FIG. 13 are expressed by serial numbers from the frames shown in FIG. 8. In the processing example 2, various conditions are set as follows:

(1) Image X

Image XA (one example of the first image) and Image XB (one example of the second image) are included.

Image XA (all-white image): For all the pixels, X=0 (one example of the first gray level); and Image XB (all-black image): For all the pixels, X=1 (one example of the second gray level)

(2) Data Writing Condition in Step SC7

Commonly applied to both Image XA and Image XB

When R>0: Black writing

When R<0: White writing

In Case of Image XA

When R=0 and D>0: White writing

In Case of Image XB

When R=0 and D<5: Black writing

Writing is not carried out in cases other than the above.

(3) End Condition

In case of Image XA: Dmax≤0 (one example of the first reference value)

In case of Image XB: D=5 (one example of the second reference value) for all pixels (Or, Dmin≥5).

In the 26$^{th}$ frame, first, the image XA is set (step SC1). For the pixel 2 and the pixel 3, the gray level value C and the gray level value X are different (step SC4: NO), and the remainder frequency R is 0 (step SC5: YES), such that the remainder frequency is set to "−5" (step SC6). The remainder frequency for other pixels is not changed. White writing is performed for the pixel 2 and the pixel 3 (step SC7). In response to the white writing, the frequency difference D of the pixel 2 is updated from "11" to "10," and the frequency difference D of the pixel 3 is updated from "5" to "4," respectively (step SC8). In addition, in response to the white writing, the remainder frequency R of the pixel 2 and the pixel 3 is incremented from "−5" to "−4" (the absolute value of the remainder frequency R is decremented) (step SC9). These processing are repeated until R becomes R=0 for all the pixels in the 30$^{th}$ frame (until the condition in step SC15 is met).

The frequency difference D of the pixel 2 is "6" at the time of the end of the 30$^{th}$ frame, and the end condition has not yet been met (step SC16: NO). Therefore, white writing for the pixel 2 is repeated until the frequency difference D of the pixel 2 becomes "0" and the end condition is met in the 36$^{th}$ frame.

In step SC8 in the 36$^{th}$ frame, the frequency difference D of the pixel 2 is updated to "0," and the end condition is met (step SC16: YES). At this point, the optical state of all the pixels is in the white display state.

In the 37$^{th}$ frame, the image XB is set (step SC1). Because, for all the pixels, the gray level value C and the gray level value X are different (step SC4: NO), and the remainder frequency R is 0 (step SC5: YES), the remainder frequency is set to "5" (step SC6). Black writing is performed for all the pixels (step SC7). In response to the black writing, the frequency difference D of the pixel 1 is updated from "−9" to "−8", and the frequency difference D of the pixel 2 is updated from "0" to "1," respectively (step SC8). In addition, in response to the black writing, the remainder frequency R for all the pixels is decremented from "5" to "4" (step SC9). These processings are repeated until R=0 is reached for all the pixels in the $41^{st}$ frame (until the condition in step SC15 is met).

At the time of the end of the $41^{st}$ frame, the frequency difference D of the pixel 1 is "−4," and the end condition has not yet been met (step SC16: NO). Therefore, black writing for the pixel 1 is repeated until the frequency difference D of the pixel 1 becomes "5" and the end condition is met in the 50th frame.

In step SC8 of the $50^{th}$ frame, the frequency difference D of the pixel 1 is updated to "5", and the end requirement is met (step SC16: YES). At this point, the optical state of all the pixels is in the black display state. Moreover, the frequency difference D became "5" for all the pixels by writing the image XA and the image XB, and the impressed voltages assume a polarity-balanced state. As a result, deterioration of the electrophoretic elements 143 can be suppressed compared with the case where the cleanup processing is performed with the polarity balance being biased.

A cleanup processing (a predetermined image display processing) similar to the previous cleanup processing is performed for the $51^{st}$ frame and thereafter.

2-3-3. Processing Example 3

FIG. 14 shows an example of changes of data with the passage of time stored in each of the storage areas in accordance with a processing example 3. The frame numbers in FIG. 13 are expressed by serial numbers from the frames shown in FIG. 8. In the processing example 3, various conditions are set as follows:

(1) Image X

Image XA (one example of the first image) and Image XB (one example of the second image) are included.

Image XA (inverted next image): For pixels with N=0 (one example of the first gray level), X=1; and for pixels with N=1 (one example of the second gray level), X=0

Image XB (next image): For all the pixels, X=N (2) Data Writing Condition in Step SC7

Commonly applied to both Image XA and Image XB

When R>0: Black writing

When R<0: White writing

In Case of Image XA

When R=0, N=0, and D<5: Black writing

When R=0, N=1, and D>0: White writing

In Case of Image XB

When R=0, N=0, and D>0: White writing

When R=0, N=1, and D<5: Black writing

Writing is not carried out in cases other than the above.

(3) End Condition

In case of Image XA: D≥5 (one example of the second reference value) for pixels with N=0, and D≤0 (one example of the first reference value) for pixels with N=1

In case of Image XB: D=0 for pixels with N=0, and D=5 for pixels with N=1

In the $26^{th}$ frame, first, the image XA is set (step SC1). Because N1=1, N2=1, N3=0, and N4=0, gray level values X of the images XA are inversion of these values, that is, X1=0, X2=0, X3=1, and X4=1. For the pixel 2 and the pixel 4, the gray level value C and the gray level value X are different (step SC4: NO), and the remainder frequency R is 0 (step SC5: YES), such that the remainder frequency is set to "−5" and "5," respectively (step SC6). The remainder frequency for other pixels is not changed. White writing is performed for the pixel 2 and black writing is performed for the pixel 4 (step SC7). In response to the white writing, the frequency difference D of the pixel 2 is updated from "11" to "10" and, in response to the black writing, the frequency difference D of the pixel 4 is updated from "0" to "1" (step SC8). In addition, in response to the white writing, the remainder frequency R of the pixel 2 is incremented from "−5" to "−4" and, in response to the black writing, the remainder frequency R of the pixel 4 is decremented from "5" to "4" (the absolute value of the remainder frequency R is decremented) (step SC9). These processing are repeated until R becomes R=0 for all the pixels in the $30^{th}$ frame (until the condition in step SC15 is met).

The frequency difference D of the pixel 2 is "6" at the time of the end of the $30^{th}$ frame, and the end condition has not yet been met (step SC16: NO). Therefore, white writing for the pixel 2 is repeated until the frequency difference D of the pixel 2 becomes "0" and the end condition is met in the $36^{th}$ frame.

In step SC8 in the $36^{th}$ frame, the frequency difference D of the pixel 2 is updated to "0," and the end condition is met (step SC16: YES). At this point, the optical state of all the pixels is in a state of which the gray level value N is inverted.

In this example, when the end condition for the image XA is met, the cleanup processing similar to the previous cleanup processing is performed. In other words, all-black images and all-white images are alternately, repeatedly written.

In the $(37+10\times k)^{-th}$ frame, the image XB is set (step SC1). Because the gray level value X of the XB is the same as the gray level value N, they are X1=1, X2=1, X3=0, and X4=0. For the pixel 1 and the pixel 2, the gray level value C and the gray level value X are different (step SC4: NO), and the remainder frequency R is 0 (step SC5: YES), such that the remainder frequency is set to "5" (step SC6). The remainder frequency for other pixels is not changed. Black writing is performed for the pixel 1 and the pixel 2 (step SC7). In response to the black writing, the frequency difference D of the pixel 1 is updated from "−9" to "−8" and the frequency difference D of the pixel 2 is updated from "0" to "1," respectively (step SC8). In addition, in response to the black writing, the remainder frequency R of the pixel 1 and the pixel 2 is decremented from "5" to "4" (step SC9). These processing are repeated until R becomes R=0 for all the pixels in the $(42+10\times k)^{-th}$ frame (until the condition in step SC15 is met).

At the time of the end of the $(42+10\times k)^{-th}$ frame, the frequency difference D of the pixel 1 is "−4," and the end condition has not yet been met (step SC16: NO). Therefore, black writing for the pixel 1 is repeated until the frequency difference D of the pixel 1 becomes "5" and the end condition is met in the $(50+10\times k)^{-th}$ frame.

In step SC8 of the $(50+10\times k)^{-th}$ frame, the frequency difference D of the pixel 1 is updated to "5", and the end condition is met (step SC16: YES). At this point, the optical state of all the pixels is in a state shown with the gray level value N. Moreover, the frequency difference D became "0" for all pixels in the white display state, and "5" for all pixels in the black display state, by writing the image XA and the image XB, and the impressed voltages assume a polarity-balanced state. As a result, deterioration of the electrophoretic elements 143 can be suppressed compared with the case where the cleanup processing is performed with the polarity balance being biased.

2-3-4. Processing Example 4

FIG. 15 shows an example of changes of data with the passage of time stored in each of the storage areas in accordance with a processing example 4. The frame numbers in FIG. 15 are expressed by serial numbers from the frames shown in FIG. 8. In the processing example 3, various conditions are set as follows:

(1) Image X

Image XA (one example of the first image) is included.

Image XA (inverted next image): For pixels with C=0 (one example of the first gray level), X=1; and for pixels with C=1 (one example of the second gray level), X=0

(2) Data Writing Condition in Step SC7

When R>0: Black writing

When R<0: White writing

When R=0, C=0, and D>0: White writing

When R=0, C=1, and D<5: Black writing

Writing is not carried out in cases other than the above.

(3) End Condition

In case of Image XA: D≤0 (one example of the first reference value) for pixels with C=0, and D≥5 (one example of the second reference value) for pixels with C=1

In the $26^{th}$ frame, the image XA is set (step SC1). Because C1=0, C2=1, C3=1, and C4=0, gray level values X of the images XA are inversion of these values, that is, X1=1, X2=0, X3=0, and X4=1. For all the pixels, the gray level value C and the gray level value X are different (step SC4: NO), and the remainder frequency R is 0 (step SC5: YES), such that the remainder frequency is set to "5" or "−5," respectively (step SC6). Black writing is performed for the pixel 1 and the pixel 4, and white writing is performed for the pixel 2 and the pixel 3 (step SC7). In response to the black writing, the frequency differences D of the pixel 1 and the pixel 4 are updated from "−9" to "−8" and from "0" to "1," respectively (step SC8). In response to the white writing, the frequency differences D of the pixel 2 and the pixel 3 are updated from "11" to "10" and from "5" to "4," respectively (step SC8). In addition, in response to the black writing, the remainder frequency R of the pixel 1 and the pixel 4 is decremented from "5" to "4" and, in response to the white writing, the remainder frequency R of the pixel 2 and the pixel 3 is incremented from "−5" to "−4" (the absolute value of the remainder frequency R is decremented) (step SC9). These processing are repeated until R becomes R=0 for all the pixels in the $30^{th}$ frame (until the condition in step SC15 is met).

At the time of the end of the $30^{th}$ frame, the frequency difference D of the pixel 1 is "−4" and the frequency difference D of the pixel 2 is "6," and therefore the end condition has not yet been met (step SC16: NO). Therefore, white writing is repeated for the pixel 2 until the $36^{th}$ frame where the frequency difference D of the pixel 2 becomes "0," and black writing is repeated for the pixel 1 until the $39^{th}$ frame where the frequency difference D of the pixel 1 becomes "5," and the end condition is met for all the pixels.

In step SC8 in the $39^{th}$ frame, the frequency difference D of the pixel 1 is updated to "5," and the end condition is met (step SC16: YES). At this point, the optical state of all the pixels is in a state of which the gray level value C before the cleanup preprocessing (the $25^{th}$ frame) is inverted. Moreover, the frequency difference D became "0" for all pixels in the white display state, and "5" for all pixels in the black display state, by writing the image XA, and the impressed voltages assume a polarity-balanced state. As a result, deterioration of the electrophoretic elements 143 can be suppressed compared with the case where the cleanup processing is performed with the polarity balance being biased. A cleanup processing (a predetermined image display processing) similar to the previous cleanup processing is performed for the $40^{th}$ frame and thereafter.

2-3-5. Processing Example 5

FIGS. 16A and 16B show an example of changes in data with the passage of time stored in each of the storage areas in accordance with a processing example 5. FIG. 16A shows the gray level value N, the optical state H, and the impressed voltage V. FIG. 16B shows the remainder frequency R and the frequency difference D. The initial state in FIGS. 16A and 16B is expressed as the 0th frame again, as they are not continuous from FIG. 8. FIGS. 16A and 16B show storage areas of the pixel 1 to the pixel 8 among plural pixels. In the processing example 5, data in the storage areas in the $0^{th}$ frame are follows.

In the processing example 5, various conditions are set as follows:

(1) Image X

Image XA (one example of the first image), Image XB (one example of the second image), and Image XC (one example of the third image) are included.

Image XA (present image): For all the pixels, X=C

Image XB (all-black image): For all the pixels, X=1 (one example of the second gray level)

Image XC (all-white image): For all the pixels, X=0 (one example of the first gray level)

(2) Data Writing Condition in Step SC7

In Case of Image XA

When N=0 and D<0: Black writing

When N=1 and D<5: Black writing

When N=0 and D>0: White writing

When N=1 and D>5: White writing

In Case of Image XB

When D<5: Black writing

In Case of Image XC

When D>0: White writing

Writing is not carried out in cases other than the above.

(3) End Condition

In Case of Image XA:

For pixels with N=0, D=0 (one example of the first reference value)

For pixels with N=1, D=5 (one example of the second reference value)

In Case of Image XB:

For all the pixels, D=5

In Case of Image XC:

For all the pixels, D=0

In the $1^{st}$ frame, first, the image XA is set (step SC1). For all the pixels, X=C. For all the pixels, because the gray level value C and the gray level value X are the same (step SC4: YES), the remainder frequency R is not set, and data is written in the line memory. For the pixel 1, because N=0 and D<0, black writing is performed. For the pixel 2 and the pixel 3, because N=0 and D>0, white writing is performed. For the pixel 5 and the pixel 6, because N=1 and D<5, black writing is performed. For the pixel 7, because N=1 and D>5, white writing is performed (step SC7). In response to the black writing, the frequency difference D for the pixel 1, the pixel 5 and the pixel 6 is updated from "−9" to "−8," from "0" to "1" and from "−3" to "−2," respectively. In response to the white writing, the frequency difference D for the pixel 2, the pixel 3 and the pixel 7 is updated from "11" to "10," from "1" to "0" and from "8" to "7," respectively (step SC8). Because the remainder frequency R is "0" for all the pixels, the remainder frequency R remains to be "0" even when the processing is executed in step SC9. These processings are repeated until the end condition is met for all the pixels in the $1^{st}$ frame.

In step SC8 of the $11^{th}$ frame, the frequency difference D of the pixel 2 is updated to "0", and the end requirement is met for all the pixels (step SC16: YES). At this point, the optical state of the pixel 7, for example, is "2" and not all pixels are necessarily in the decided optical state ("0" or "5"). Also by writing the image XA, the frequency difference D became "0" for all pixels with N=0 and "5" for all pixels with N=1, such that the impressed voltages assume a polarity-balanced state. Note that, while the image XA is being written, the remainder frequency R is R=0 for all the pixels, such that C is updated to C=N in step SC11. Therefore, C1=C2=C3=C4=0, and C5=C6=C7=C8=1 are obtained at the time of the end of the $11^{th}$ frame.

In the $12^{th}$ frame, the image XB is set (step SC1). Because, for the pixels 1-4, the gray level value C and the gray level value X are different (step SC4: NO), and the remainder frequency R is 0 (step SC5: YES), the remainder frequency is set to "5" (step SC6). The remainder frequency is not set for the pixels 5-8. Black writing is performed for the pixels 1-4 (step SC7). In response to the black writing, the frequency difference D of the pixels 1-4 is updated from "0" to "1" (step SC8). In addition, in response to the black writing, the remainder frequency R for the pixels 1-4 is decremented from "5" to "4" (step SC9). These processings are repeated until R becomes R=0 for all the pixels in the $16^{th}$ frame (until the condition in step SC15 is met).

In step SC8 of the $16^{th}$ frame, the frequency difference D of the pixels 1-4 is updated to "5", and the end requirement is met for all the pixels (step SC16: YES). The frequency difference D became "5" for all the pixels by writing the image XB.

In the $17^{th}$ frame, the image XC is set (step SC1). Because, for all the pixels, the gray level value C and the gray level value X are different (step SC4: NO), and the remainder frequency R is 0 (step SC5: YES), the remainder frequency is set to "−5" (step SC6). White writing is performed for all the pixels (step SC7). In response to the white writing, the frequency difference D of all the pixels is updated from "5" to "4" (step SC8). In addition, in response to the white writing, the remainder frequency R for all the pixels is incremented from "−5" to "−4" (the absolute value of the remainder frequency R is decremented) (step SC9). These processings are repeated until R becomes R=0 for all the pixels in the $21^{st}$ frame (until the condition in step SC15 is met).

In step SC8 of the $21^{st}$ frame, the frequency difference D for all the pixels is updated to "0", and the end requirement is met for all the pixels (step SC16: YES). At this point, the optical state of all the pixels is "0." Moreover, the frequency difference D became "0" for all the pixels by writing the image XC, and the impressed voltages assume a polarity-balanced state. As a result, deterioration of the electrophoretic elements 143 can be suppressed compared with the case where the cleanup processing is performed with the polarity balance being biased. A cleanup processing (a predetermined image display processing) similar to the prior cleanup processing is performed for the $22^{nd}$ frame and thereafter.

2-3-6. Processing Example 6

FIGS. 17A and 17B show an example of changes of data with the passage of time stored in each of the storage areas in accordance with a processing example 6. FIG. 17A shows the gray level value N, the optical state H, and the impressed voltage V. FIG. 17B shows the remainder frequency R and the frequency difference D. The initial state in FIGS. 17A and 17B is expressed as the $0^{th}$ frame again, as they are not continued from FIG. 8. FIGS. 17A and 17B show storage areas of the pixel 1 to the pixel 8 among plural pixels. In the processing example 6, data in the storage areas for the $0^{th}$ frame are the same as those in the processing example 5.

In the processing example 6, various conditions are set as follows:

(1) Image X

Image XA (one example of the first image) and Image XB (one example of the second image) are included.

Image XA (present image): For all the pixels, X=C

Image XB (all-black image): For all the pixels, X=1 (one example of the second gray level)

(2) Data Writing Condition in Step SC7

In Case of Image XA

When D<0: Black writing

When D>0: White writing

In Case of Image XB

When D<5: Black writing

Writing is not carried out in cases other than the above.

(3) End Condition

In Case of Image XA:

For all the pixels, D=0 (one example of the first reference value)

In Case of Image XB:

For all the pixels, D=5 (one example of the second reference value) Accordingly, in this example, first of all, the frequency difference D is generally set to "0" for all the pixels.

In the $1^{st}$ frame, first, the image XA is set (step SC1). For all the pixels, X=C. For all the pixels, because the gray level value C and the gray level value X are the same (step SC4: YES), the remainder frequency R is not set, and data is written in the line memory. For the pixel 1 and the pixel 6, because D<0, black writing is performed. For the pixel 2, the pixel 3, the pixel 7 and the pixel 8, because D>0, white writing is performed (step SC7). In response to the black writing, the frequency difference D for the pixel 1 and the pixel 6 is updated from "−9" to "−8" and from "−3" to "−2," respectively. In response to the white writing, the frequency difference D for the pixel 2, the pixel 3, the pixel 7 and the pixel 8 is updated from "11" to "10," from "1" to "0," from "8" to "7" and from "5" to "4," respectively (step SC8). Because the remainder frequency R is "0" for all the pixels, the remainder frequency R remains to be "0" even when the processing is executed in step SC9. These processings are repeated until the end condition is met for all the pixels in the $11^{th}$ frame.

In step SC8 of the $11^{th}$ frame, the frequency difference D of the pixel 2 is updated to "0", and the end requirement is met for all the pixels (step SC16: YES). At this point, not all pixels are necessarily in the decided optical state ("0" or "5"). Also by writing the image XA, the frequency difference D becomes "0" for all the pixels such that the impressed voltages assume a polarity-balanced state. Note that, while the image XA is being written, the remainder frequency R is R=0 for all the pixels, such that C is updated to C=0 in step SC11. Therefore, C1-C8=0 at the time of the end of the $11^{th}$ frame.

In the $12^{th}$ frame, the image XB is set (step SC1). Because, for all the pixels, the gray level value C and the gray level value X are different (step SC4: NO), and the remainder frequency R is 0 (step SC5: YES), the remainder frequency is set to "5" (step SC6). Black writing is performed for all the pixels (step SC7). In response to the black writing, the frequency difference D of the pixels 1-8 is updated from "0" to "1" (step SC8). In addition, in response to the black writing, the remainder frequency R for the pixels 1-8 is decremented from "5" to "4" (step SC9). These processings are repeated until R=0 is reached for all the pixels in the $16^{th}$ frame (until the condition in step SC15 is met).

In step SC8 of the $16^{th}$ frame, the frequency difference D of the pixels 1-8 is updated to "5", and the end requirement is met for all the pixels (step SC16: YES). At this point, the optical state of all the pixels is "5." Moreover, the frequency difference D has become "5" for all the pixels by writing the image XB, such that the impressed voltages assume a polarity-balanced state. As a result, deterioration of the electrophoretic elements 143 can be suppressed compared with the case where the cleanup processing is performed with the polarity balance being biased. A cleanup processing (a predetermined image display processing) similar to the prior cleanup processing is performed for the $17^{th}$ frame and thereafter.

2-3-7. Processing Example 7

FIG. 18 shows an example of changes of data with the passage of time stored in each of the storage areas in accordance with a processing example 7. FIG. 18 shows the storage areas of the pixel 1 and the pixel 2 among the plural pixels. In the processing example 7, various conditions are set as follows:

(1) Image X

Image XA and Image XB are included.

Image XA:

For pixels with D>Dmin, X=0

For pixels with D=Dmin, X=C

Image XB (all-black image): For all the pixels, X=1

(2) Data Writing Condition in Step SC7

Commonly applied to both Image XA and Image XB

When R>0: Black writing

When R<0: White writing

In Case of Image XA

When R=0, and D>Dmin: White writing

In Case of Image XB

When R=0, and D<5: Black writing (3) End Condition

In case of Image XA: Dmax=Dmin

In case of Image XB: D=5 for all the pixels (or Dmin≥5)

Accordingly, in this example, first of all, the frequency difference D is generally set to the minimum value Dmin for all the pixels.

In FIG. 18, the adjustment processing is performed during the period between the $1^{st}$ frame and the $20^{th}$ frame. An image XA is set for the period between the $1^{st}$ frame and the $9^{th}$ frame (step SC1). An image XB is set for the period between the $10^{th}$ frame and the $20^{th}$ frame (step SC 1).

In the first frame, first, the image XA is set (step SC1). For the image XA, X1=0 and X2=C. For the pixel 2, because the gray level value C and the gray level value X are different (step SC4: NO), and the remainder frequency R is 0 (step SC5" YES), the remainder frequency is set to "−5" (step SC6). For the pixel 1, the remainder frequency is not updated. For the pixel 2, white writing is performed (step SC7). In response to the white writing, the frequency difference D for the pixel 2 is updated from "3" to "2" (step SC8). In addition, in response to the white writing, the remainder frequency R of the pixel 2 is incremented from "−5" to "−4" (the absolute value of the remainder frequency R is decremented) (step SC9). These processings are repeated until R becomes R=0 in the $5^{th}$ frame for all the pixels (until the condition in step SC15 is met).

At the time of the end of the $5^{th}$ frame, the frequency difference D of the pixel 2 is "−2," and the end condition has not yet been met (step SC16: NO). Therefore, white writing is repeated for the pixel 2 until the $9^{th}$ frame where the frequency difference D of the pixel 2 becomes the minimum value "−6" and the end requirement is met.

In step SC8 of the $9^{th}$ frame, the frequency difference D of the pixel 2 is updated to "−6", and the end condition is met (step SC16: YES). At this point, the optical state of all the pixels is in the white display state.

In the $10^{th}$ frame, the image XB is set (step SC1). After the image XB is set, a processing similar to the processing performed after the image XB is set in the processing example 2 is performed. By writing the image XA and the image XB, the frequency difference D assumes a state in which the impressed voltages are in a polarity-balanced state. As a result, deterioration of the electrophoretic elements 143 can be suppressed compared with the case where the cleanup processing is performed with the polarity balance being biased.

In the example described above, first, the frequency difference D for all the pixels was generally set to the minimum value Dmin. However, the frequency difference D may be generally set to the maximum value Dmax for pixels with D>0, and may be generally set to the minimum value Dmin for pixels with D<0, Specific conditions may be set as follows.

(1) Image X

Image XA (one example of the first image), Image XB (one example of the second image), and Image XC (one example of the third image) are included.

Image XA: For pixels with Dmin<D<0 (one example of the first reference value), X=0 (one example of the first gray level)

For pixels with 0<D<Dmax, X=1 (one example of the second gray level)

Note that, for pixels with D=0, either X=0 or X=1 may be used.

Image XB (all-white image): For all the pixels, X=0

Image XC (all-black image): For all the pixels, X=1

(2) Data Writing Condition in Step SC7

Commonly applicable to Image XA, Image XB and Image XC

When R>0: Black writing

When R<0: White writing

In Case of Image XA

When R=0 and Dmin<D<0: White writing

When R=0 and 0<D<Dmax: Black writing

In Case of Image XB

When R=0 and D>0: White writing

In Case of Image XC

When R=0 and D<0: Black writing

Writing is not carried out in cases other than the above.

(3) End Condition

In Case of Image XA:

For pixels with D<0, D=Dmin

For pixels with D>0, D=Dmax

Note that, for pixels with D=0, either D=Dmin or D=Dmax may be used according to the condition of Image XA.

In Case of Image XB:

Dmax≤0 (one example of the first reference value)

In Case of Image XC:

Dmin≥5 (one example of the first reference value)

2-3-8. Processing Example 8

FIGS. 19A and 19B show an example of changes of data with the passage of time stored in each of the storage areas in accordance with a processing example 8. The frame numbers in FIG. 19A are expressed by serial numbers from the frames shown in FIG. 8. FIG. 19B shows data of the storage areas from the $25^{th}$ frame to the $59^{th}$ frame. FIG. 19B shows data of the storage areas after the $60^{th}$ frame. In the processing example 8, various conditions are set as follows:

(1) Image X XA: Inverted Present Image, XB: Present Image
Image XA and Image XB are included.

Image XA (Inverted Present Image):
For pixels with C=0, X=1; and for pixels with C=1, X=0

Image XB (Present Image):
For all the pixels, X=C (2) Data Writing Condition in Step SC7
Commonly applicable to Image XA and Image XB
When R>0: Black writing
When R<0: White writing In Case of Image XA:
When R=0, C=0, and D>0: White writing
When R=0, C=1, and D<5: Black writing Writing is not carried out in cases other than the above.

(3) End Condition
In case of Image XA: D≤0 for pixels with C=0, and D≥5 for pixels with C=1

As a condition peculiar to the processing example 8, when the end condition is not met in the case of the image XA (step SC16: NO), the controller 20 judges whether writing of the image XA has been performed consecutively a predetermined number of times (for example, eight times) (not shown in the figure). When the writing of the image XA has not reach the predetermined number of times, the controller 20 continues writing the image XA. When the writing of the image XA has reached the predetermined number of times, the controller 20 sets the image XB.

In case of Image XB: The end condition (step SC16) is not judged. When all remainder frequencies R are "0" (step SC15: YES), the controller 20 sets the image XA.

In FIG. 19, the adjustment processing is performed between the $26^{th}$ frame and the $59^{th}$ frame. In the adjustment processing in the processing example 8, the image XA and the image XB are alternately, repeatedly set. For instance, the image XA is set for the period from the $26^{th}$ frame to the $33_{rd}$ frame (step SC1). Moreover, the image XB is set for the period from the $34^{th}$ frame to the $38^{th}$ frame (step SC1).

In the $26^{th}$ frame, first, the image XA is set (step SC1). The gray level values X of the images XA are X1=1, X2=0, X3=0, and X4=1. Black writing is performed for the pixel 1 and the pixel 4 similarly to the processing in the processing example 4, and white writing is performed for the pixel 2 and the pixel 3 (step SC7). These processings are repeated until R becomes R=0 in the $30^{th}$ frame for all the pixels (until the condition in step SC15 is met).

At the time of the end of the $30^{th}$ frame, the frequency difference D of the pixel 1 is "−4", and the frequency difference D of the pixel 2 is "6", such that the end condition has not yet been met (step SC16: NO). Writing of the image XA occurred five times, and has not reached 8 times. Therefore, until the $33^{rd}$ frame where the number of writing of the image XA reaches eight times, white writing is repeated for the pixel 2, and black writing is repeated for the pixel 1.

In the $34^{th}$ frame, the image XB is set (step SC1). The gray level values of the image XB are X1=0, X2=1, X3=1, and X4=0. For all the pixels, the gray level value C and the gray level value X are different (step SC4: NO), and the remainder frequency R is 0 (step SC5: YES), such that the remainder frequency is set to "5" or "−5," respectively (step SC6). White writing is performed for the pixel 1 and the pixel 4, and black writing is performed for the pixel 2 and the pixel 3 (step SC7). These processings are repeated until R becomes R=0 for all the pixels in the $38^{th}$ frame (until the condition in step SC15 is met).

In the $39^{th}$ frame, the image XA is set again (step SC1). A processing similar to the processing described above is repeated from the $39^{th}$ frame to the $59^{th}$ frame. In step SC8 of the $59^{th}$ frame, the frequency difference D of the pixel 1 is updated to "5," and the end condition is met (step SC16: YES). At this point, for all the pixels, the impressed voltages assume a polarity-balanced state. By repeatedly, alternately setting the image XA and the image XB, non-uniformity in the migration of the electrophoretic elements 143, which may be caused by application of the voltage with the same polarity exceeding a predetermined number of times, can be suppressed.

2-3-9. Processing Example 9

FIGS. 20A and 20B show an example of changes in data with the passage of time stored in each of the storage areas in accordance with a processing example 9. The initial state in FIGS. 20A and 20B is expressed as the $0^{th}$ frame again, as they are not continued from FIG. 8. FIG. 20A shows data of the storage areas for the $0^{th}$ frame to the $30^{th}$ frame. FIG. 20B shows data of the storage areas for the $31^{st}$ frame and thereafter. In the processing example 9, various conditions are set as follows:

(1) Image X
Image XA (one example of the first image) and Image XB (one example of the second image) are included.
Image XA (all-black image): For all the pixels, X=1 (one example of the first gray level)
Image XB (all-white image): For all the pixels, X=0 (one example of the second gray level)

(2) Data Writing Condition in Step SC7
Commonly applicable to Image XA and Image XB
When R>0: Black writing
When R<0: White writing In Case of Image XA
When R=0, and D<5: Black writing In Case of Image XB
When R=0, and D>0: White writing (3) End Condition
In case of Image XA: Dmin≥5
In case of Image XB: Dmax≤0

As a condition peculiar to the processing example 9, when the end condition is not met (step SC16: NO), the controller 20 judges whether writing of the image XA or the image XB has been performed consecutively a predetermined number of times (for example, 6 times) (not shown in the figure). When the writing has not reached the predetermined number of times, the controller 20 continues writing the image XA or the image XB. When the writings has reached the predetermined number of times, the controller 20 sets the image XB or the image XA.

In the adjustment processing of the processing example 9, in both cases of starting black writing and beginning white writing, the absolute value of the remainder frequency is set to three times. In other words, in the black writing, a remainder frequency less than 3 times, i.e., the frequency of voltage impression required to change the display state from a white display to a black display is set. Also, in the white writing, the remainder frequency less than 5 times, i.e., the voltage impression frequency required to change the display state from a white display to a black display is set.

In FIG. 20, the adjustment processing is performed between the $1^{st}$ frame and the $30^{th}$ frame. In the adjustment processing in the processing example 9, the image XA and the image XB are alternately, repeatedly set. For instance, the image XA is set for the period from the $1^{st}$ frame to the $6^{th}$ frame (step SC1). Also, the image XB is set for the period from the $7^{th}$ frame to the $12^{th}$ frame (step SC1).

In the $1^{st}$ frame, first, the image XA is set (step SC1). The gray level values X of the images XA are X1-X4=1. For the pixel 1 and the pixel 4, because the gray level value C and the gray level value X are different (step SC4: NO), and the remainder frequency R is 0 (step SC5" YES), the remainder frequency is set to "3" (step SC6). Black writing is performed for the pixel 1 and the pixel 4. These processings are repeated until R becomes R=0 in the 3rd frame for all the pixels (until the condition in step SC15 is met).

At the time of the end of the 3rd frame, the frequency difference D of the pixel 1 is "−4," and the end condition has not yet been met (step SC16: NO). Writing of the image XA has been performed 3 times, but has not reached 6 times. Therefore, black writing is repeatedly performed for the pixel 1 until the frequency of writing of the image XA reaches 6 times in the $6^{th}$ frame.

In the $7^{th}$ frame, the image XB is set (step SC1). The gray level values X of the image XB are X1-X4=0. For all the pixels, because the gray level value C and the gray level value X are different (step SC4: NO), and the remainder frequency R is 0 (step SC5" YES), the remainder frequency is set to "−3" (step SC6). For the pixels 1-4, white writing is performed (step SC7). These processings are repeated until R=0 is reached for all the pixels in the $9^{th}$ frame (until the condition in step SC15 is met).

At the time of the end of the $9^{th}$ frame, the frequency difference D of the pixel 2 is "8," and the end condition has not yet been met (step SC16: NO). Writing of the image XB has been performed 3 times, but has not reached 6 times. Therefore, white writing is repeatedly performed for the pixel 2 until the frequency of writing of the image XB reaches 6 times in the $12^{th}$ frame.

In the $13^{th}$ frame, the image XA is set again (step SC1). A processing similar to the processing described above is repeated from the $13^{th}$ frame to the $30^{th}$ frame. In step SC8 of the $30^{th}$ frame, the frequency difference D of the pixel 1 is updated to "5," and the end condition is met (step SC16: YES). At this point, for all the pixels, the impressed voltages assume a polarity-balanced state. By reducing the absolute value of the remainder frequency to less than the voltage impression frequency required for black writing or white writing, non-uniformity in the migration of the electrophoretic elements 143, which may be caused by application of the voltage with the same polarity exceeding a predetermined number of times, can be suppressed.

3. Modification Example

The invention is not limited to the embodiments described above, and can be implemented in various forms. Hereafter, some modification examples will be described. Two or more of the modification examples may be used in combination.

3-1. Modification Example 1

The end condition is not limited to the case in which it is judged in relation with the reference value decided for each pixel. The end condition may be one in which it judged in relation with the frequency difference with respect to other pixels, for example, an adjoined pixel, for example. For instance, the end condition may be one in which a pixel with D=0 (one example of the first reference value) and a pixel with D=1 (one example of the second reference value) are alternately arranged.

3-1. Modification Example 2

The difference between the first reference value and the second reference value (one example of the first difference) is not limited to a difference equal to a larger value in the frequencies of voltage impression described in the embodiment. It is possible to use a condition in which a difference between the difference of the first reference value to the second reference value and a larger frequency value (one example of the second difference) is less than a threshold value. For instance, as the end condition of the processing example 1, in the case of the image XA, it may be judged from the condition of Dmin≥4.

3-3. Modification Example 3

FIG. 21 shows an example showing changes in data stored in each storage area with the lapse of time in accordance with a modification example 3. The relation between the optical state of the pixel 14 and the frequency difference D is limited to the one described in the embodiments. In the embodiment described above, it is judged that the final end condition has been met, when the frequency difference D for pixels 14 in black display becomes a reference value corresponding to black writing (for instance, "5"), and when the frequency difference D for pixels 14 in white display becomes a reference value corresponding to white writing (for instance, "0"). However, an offset may be added to the reference value. In the example in FIG. 21, an offset is set in the direction of a positive voltage eight times. In other words, the cleanup processing ends, finally, when the frequency difference D of the pixel 14 in black display becomes "13" and the frequency difference D of the pixel in white display becomes "8." At the time of the end of the processing of the $11^{th}$ frame, the optical state of the pixel 1 and the pixel 2 assumes the black display state. Both of the frequency differences D become "5" in which the impressed voltages are in a polarity-balances state. Thereafter, the voltage impression of a black voltage is further carried out eight times (one example of a predetermined frequency) between the $22^{nd}$ frame and the $29^{th}$ frame during which the optical state of the pixel 1 and the pixel 2 is in the black display state. In this manner, an offset may be added to the frequency difference D at the end of the cleanup processing, such that, for example, when there is a tendency that the frequency difference D would likely be biased to the negative pole side in the image rewriting processing, the bias can be reduced in the frequency difference D in the image rewriting processing.

3-4. Modification Example 4

In the image rewriting operation shown in FIG. 8, an example is described in which the absolute value of the initial value of the remainder frequency is the same for the cases of white writing and black writing. However, the initial value of the remainder frequency may be different for the cases of white writing and black writing. In this case, the storage device 22 may store an initial value for white writing and an initial value for black writing. The memory control device 21 reads the initial value corresponding to the polarity of writing from the memory device 22. Note that, in the cleanup processing, the initial value of the remainder frequency may preferably be the same for the cases of white writing and black writing, so that the impressed voltages assume a polarity-balanced state.

3-5. Modification Example 5

In the image rewriting operation shown in FIG. 8, an example is described in which the initial value of the remainder frequency is constant in both of the cases of white writing and black writing, regardless of the optical state of the pixels 14. However, the number of voltage impressions (that is, the initial value of the remainder frequency) may be made different according to the optical state of the pixels 14.

3-6. Modification Example 6

The composition of the controller 20 is not limited to the one exemplified in FIG. 6. If the function of FIG. 6 can be achieved, the controller 20 may have any composition. For instance, the controller 20 may have a frame memory or a dot memory, in place of the line memory. In another example, a part of the function of the controller 20 may be served by other elements, such as, the CPU 30 and the RAM 50. In this case, the electronic equipment 1 only has to have the function described in FIG. 6 as a whole. Moreover, the order of the operations, especially, the order of the processings executed by the controller 20 is not limited to the one described by the flow chart shown in each of FIG. 7, FIG. 9, FIG. 10, and FIG. 11. For instance, the processing in which the remainder frequency R is updated in FIG. 7 (step SA13) may be done before the processing in which the frequency difference D is updated (step SA12).

3-7. Modification Example 7

The electronic equipment 1 is not limited to the electronic book leader. The electronic equipment 1 may be a personal computer, a PDA (Personal Digital Assistant), a cellular phone, a smart phone, a tablet terminal or a portable game machine.

The structure of the pixel 14 is not limited to the one described in the embodiment. For instance, the polarity of charged particles is not limited to the one described in the embodiment. Black electrophoretic particles may be negatively charged, and white electrophoretic particle may be positively charged. In this case, the polarity of each voltage to be impressed to the pixels becomes reverse to the one explained in the embodiment. Moreover, the display element is not limited to an electrophoretic type display element using microcapsules. Other display elements, such as, a liquid crystal element, an organic EL (Electro Luminescence) element, etc. may be used.

The number of repetition in step SD17 may be set to any number of times for the predetermined image display processing. Moreover, the predetermined image display processing may not need to be performed. The parameters (for instance, the number of gray levels, the number of pixels, the voltage value, and voltage impression frequency, etc.) described above in the embodiment are for illustration purpose only, and the invention is not limited to these parameters.

The entire disclosure of Japanese Patent Application No. 2011-246622, filed Nov. 10, 2011 is expressly incorporated by reference herein.

What is claimed is:

1. A control device comprising:

a memory control device that controls access, for each of plural pixels whose gray level changes from a first gray level to a second gray level by voltage application multiple times in a predetermined period as the unit, to a first memory that stores a present gray level value, a second memory that stores a gray level value to be displayed next, a third memory that stores a remainder frequency of voltage applications, and a fourth memory that stores a difference between the frequency of applications of a first voltage by which the pixel is changed to the first gray level and the frequency of applications of a second voltage by which the pixel is changed to the second gray level; and a drive control device that controls, for a target pixel to be processed among the plural pixels, to apply a voltage to the target pixel, when the gray level value stored in the first memory and the gray level value stored in the second memory are mutually different, and the remainder frequency stored in the third memory is not zero, the drive control device rewriting, for the target pixel, the remainder frequency to a set value decided according to the gray level value stored in the second memory, when a comparison result between the gray level value stored in the first memory and the gray level value stored in the second memory and the remainder frequency stored in the third memory meet a predetermined condition, the drive control device performing a cleanup processing that includes displaying a predetermined image at the plural pixels with a predetermined timing, wherein the cleanup processing includes an adjustment processing of writing an adjustment image to the multiple pixels by voltage application thereto until the difference meets a predetermined end condition.

2. The control device according to claim 1, wherein the adjustment image includes a first image in which the gray level of all pixels of the plural pixels is the first gray level, and a second image in which the gray level of all pixels of the plural pixels is the second gray level, and the end condition is a condition in which, in the first image, the minimum value of the difference stored in the fourth memory is more than a first reference value decided according to the first gray level, and in the second image, the maximum value of the difference stored in the fourth memory is less than a second reference value decided according to the second gray level.

3. The control device according to claim 1, wherein the adjustment image includes a first image expressed by a gray level value that is an inversion of the gray level value stored in the second memory, and a second image expressed by the gray level value stored in the second memory, the end condition is a condition in which, in the first image, for a pixel whose gray level value stored in the second memory is a first gray level, the difference stored in the fourth memory is more than a second reference value decided according to the second gray level, and for a pixel whose gray level value stored in the second memory is a second gray level, the difference stored in the fourth memory is less than a first reference value decided according to the first gray level; and in the second image, for a pixel whose gray level value stored in the second memory is a first gray level, the difference stored in the fourth memory is the first reference value, and for a pixel whose gray level value stored in the second memory is a second gray level, the difference stored in the fourth memory is the second reference value.

4. The control device according to claim 1, wherein the adjustment image includes a first image expressed by a gray level value that is an inversion of the gray level value stored in the first memory, and the end condition is a condition in which, in the first image, for a pixel whose gray level value stored in the first memory is the first gray level, the difference stored in the fourth memory is less than a first reference value decided according to the first gray level, and for a pixel whose gray level value stored in the first memory is the second gray level, the difference stored in the fourth memory is more than a second reference value decided according to the second gray level.

5. The control device according to claim 1, wherein the adjustment image includes a first image in which the gray level of all pixels of the plural pixels indicates a gray level value stored in the first memory, a second image in which the gray level of all pixels of the plural pixels is the second gray level, and a third image in which the gray level of all pixels of the plural pixels is the first gray level, and the end condition is a condition in which, in the first image, for a pixel whose gray level value stored in the second memory is a first gray level, the difference stored in the fourth memory is a first reference value decided according to the first gray level, and for a pixel whose gray level value stored in the second memory is a second gray level, the difference stored in the fourth memory is a second reference value decided according to the second gray level;

a condition in which, in the second image, the difference for all pixels is the second reference value; and a condition in which, in the third image, the difference for all pixels is the first reference value.

6. The control device according to claim 1, wherein the adjustment image includes a first image in which the gray level of all pixels of the plural pixels indicates a gray level value stored in the first memory, and a second image in which the gray level of all pixels of the plural pixels is the second gray level, and the end condition is a condition in which, in the first image, for all pixels in the plural pixels, the difference stored in the fourth memory is a first reference value decided according to the first gray level; and a condition in which, in the second image, for all pixels in the plural pixels, the difference stored in the fourth memory is a second reference value decided according to the second gray level.

7. The control device according to claim 1, wherein the adjustment image includes a first image that indicates the first gray level for a pixel in which the difference stored in the fourth memory is less than a first reference value decided according to the first gray level and greater than the minimum value of the difference and indicates the second gray level for a pixel in which the difference is greater than the first reference value and less than the maximum value of the difference, a second image in which the gray level of all pixels of the plural pixels is the first gray level, and a third image in which the gray level of all pixels of the plural pixels is the second gray level, and the end condition is a condition in which, in the first image, for a pixel in which the difference stored in the fourth memory is less than the first reference value, the difference is the minimum value, and for a pixel in which the difference stored in the fourth memory is greater than the first reference value, the difference is the maximum value; a condition in which, in the second image, the maximum value of the difference stored in the fourth memory is less than the first reference value; and a condition in which, in the third image, the minimum value of the difference stored in the fourth memory is less than the second reference value.

8. The control device according to claim 1, wherein the end condition is a condition in which a pixel in which the difference stored in the fourth memory is a first reference value decided according to the first gray level and a pixel in which the difference is a second reference value decided according to the second gray level are alternately disposed.

9. The control device according to claim 1, wherein the end condition further includes a condition in which writing of an identical image has been continuously executed a predetermined number of times.

10. The control device according to claim 9, wherein each of the plural pixels changes from the first gray level to the second gray level by voltage application a times, and from the second gray level to the first gray level by voltage application b times, and when the drive control device writes the adjustment image, the memory control device writes a remainder frequency smaller than the a times to the third memory for a pixel that is changed from the first gray level to the second gray level, and writes a remainder frequency smaller than the b times to the third memory for a pixel that is changed from the second gray level to the first gray level.

11. The control device according to claim 1, wherein each of the plural pixels change from the first gray level to the second gray level by voltage application a times, and from the second gray level to the first gray level by voltage application b times, and a difference between the first reference value and the second reference value is equal to a larger one of the a and the b.

12. The control device according to claim 1, wherein each of the plural pixels changes from the first gray level to the second gray level by voltage application a times, and from the second gray level to the first gray level by voltage application b times, and a second difference between a larger one of the a and the b and a first difference between a first reference value decided according to the first gray level and a second reference value decided according to the second gray level is less than a threshold value.

13. The control device according to claim 1, wherein the drive control device further applies the second voltage a predetermined number of times, in the cleanup processing, after the adjustment processing, when the gray level of each of the pixels is the second gray level.

14. The control device according to claim 1, wherein the predetermined image includes an image in which the gray level of each pixel is the first gray level and a picture in which the gray level of each pixel is the second gray level.

15. An electro-optic device comprising the control device recited in claim 1 and the plural pixels.

16. An electronic apparatus comprising the electro-optic device recited in claim 15.

17. A control method for controlling an electro-optic device having a plurality of pixels whose gray level changes from a first gray level to a second gray level by voltage application multiple times in a predetermined period as the unit, a control device, a first memory that stores a present gray level value, a second memory that stores a gray level value to be displayed next, a third memory that stores a remainder frequency of voltage applications, and a fourth memory that stores a difference between the frequency of applications of a first voltage by which the pixel is changed to the first gray level and the frequency of applications of a second voltage by which the pixel is changed to the second gray level, the control method comprising, for a target pixel to be processed among the plural pixels when the remainder frequency stored in the third memory has a value other than zero, rewriting the remainder frequency to a set value decided according to the gray level value stored in the second memory, and performing a cleanup processing that includes an adjustment processing of rewriting a present image to an adjustment image with a predetermined timing thereby displaying a predetermined image, the adjustment processing performing voltage application for a pixel having the difference other than a predetermined value, until the difference is contained within a predetermined range with respect to a predetermined value, thereby rewriting the present image to a gray level different from the present gray level.

* * * * *